US008385754B2

(12) United States Patent
Hirobe et al.

(10) Patent No.: US 8,385,754 B2
(45) Date of Patent: Feb. 26, 2013

(54) IMAGE FORMING APPARATUS FEATURING FORCED DISCHARGING OF EXCESSIVE DEVELOPER

(75) Inventors: Fumitake Hirobe, Ushiku (JP); Hideaki Suzuki, Tokyo (JP); Yoshiro Tsukada, Matsudo (JP); Masahiro Ootsuka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 12/859,387

(22) Filed: Aug. 19, 2010

(65) Prior Publication Data

US 2011/0052221 A1 Mar. 3, 2011

(30) Foreign Application Priority Data

Aug. 26, 2009 (JP) ..... 2009-196129

(51) Int. Cl.
*G03G 15/08* (2006.01)

(52) U.S. Cl. ..... 399/27; 399/119; 399/254; 399/257

(58) Field of Classification Search ..... 399/27, 399/119, 254, 256, 257, 259, 260
See application file for complete search history.

(56) References Cited

U.S. PATENT DOCUMENTS

| | | | |
|---|---|---|---|
| 5,819,132 | A | 10/1998 | Hirobe |
| 6,501,916 | B2 | 12/2002 | Suzuki |
| 6,973,281 | B2 | 12/2005 | Hirobe et al. |
| 7,013,096 | B2 | 3/2006 | Ozawa et al. |
| 7,099,609 | B2 | 8/2006 | Hirobe et al. |
| 7,231,168 | B2 | 6/2007 | Hirobe |
| 7,362,989 | B2 | 4/2008 | Nishihama et al. |
| 7,386,261 | B2 | 6/2008 | Noguchi et al. |
| 7,729,641 | B2 * | 6/2010 | Suzuki ..... 399/254 |
| 2007/0231014 | A1 | 10/2007 | Noguchi et al. |
| 2008/0240757 | A1 | 10/2008 | Suzuki |
| 2010/0098447 | A1 | 4/2010 | Ootsuka |

FOREIGN PATENT DOCUMENTS

| | | | |
|---|---|---|---|
| JP | 9-251235 | A | 9/1997 |
| JP | 10-48937 | A | 2/1998 |
| JP | 2004-206088 | A | 7/2004 |
| JP | 2008-249769 | A | 10/2008 |
| JP | 2008-287079 | A | 11/2008 |

OTHER PUBLICATIONS

Notification of the First Office Action dated Feb. 28, 2012, in Chinese Application No. 201010265928.4.

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member for bearing a latent image; a developing device, including a developer carrying member for carrying and feeding a developer including toner and a carrier to a developing position in which the developer opposes the image bearing member, for developing the latent image formed on the image bearing member; a discharging portion for permitting discharge of an excessive developer present in the developing device by supplying the developer into the developing device; a feeding member for feeding the developer in the developing device; a controller for controlling a forced discharging operation for discharging the excessive developer from the discharging portion by changing a driving condition of at least one of the developer carrying member and the feeding member; and a detecting device for detecting information correlating to flowability of the developer in the developing device. The controller is capable of controlling the forced discharging operation on the basis of a detection result of the detecting device.

5 Claims, 14 Drawing Sheets

(a) ACTUATION CONTROL (b) LOAD CHECK MODE

IMAGE FORMING APPARATUS FEATURING FORCED DISCHARGING OF EXCESSIVE DEVELOPER

FIELD OF THE INVENTION AND RELATED ART

The present invention relates to an image forming apparatus in which an excessive portion of a developer fed by a feeding screw member is discharged steadily from a discharging portion. Specifically, the present invention relates to interrupting control of a forced discharging mode effected before the excessiveness of the developer causes a problem.

An image forming apparatus including a developing device for developing a latent image on an image bearing member with a developer (two component developer) principally containing toner and a magnetic carrier has been widely used. In the developing device using the developer, the feeding screw member feeds the developer in a circulating path formed in a developing container while stirring the developer, so that the toner and the magnetic carrier are triboelectrically charged. While the toner is consumed with image formation, the magnetic carrier is continuously circulated in the developing container and therefore the surface of the magnetic carrier is gradually contaminated, so that a charging performance thereof is deteriorated. For this reason, the magnetic carrier is mixed in the developer for supply in a weight ratio of about 10% and is then supplied into the developing container, while the developer which is excessive by the supply is overflowed the discharging portion provided in the circulating path, so that an amount of the developer in the developing container is kept constant.

Japanese Laid-Open Patent Application (JP-A) Hei 10-48937 discloses a developing device in which a discharging portion capable of changing its opening area to two levels by actuating a shutter at an abutment position of a developing container. In this case, a developer which is excessive with supply of a developer for supply is overflowed from the discharging portion and by opening the shutter, it is possible to execute a forced discharging mode in which the circulating developer is discharged in an amount which is higher than a normal discharge amount.

JP-A 2004-206088 discloses a developing device in which a discharging portion is provided at a wall surface of a developing container on an opposite side from a developer carrying member and a developer which is excessive in the developing container is overflowed from the discharging portion by rotation of a feeding screw member.

JP-A 2008-287079 discloses a developing device in which a discharging screw member dedicated to discharge is disposed at the bottom of a developing container and when a developer amount in the developing container exceeds a predetermined amount, a forced discharging mode in which the discharging screw member is rotated for a predetermined time is executed.

In the developing device using the two component developer, when the amount of the developer circulating the developing container becomes insufficient, the toner in an amount necessary for the developer carrying member cannot be supplied, so that image defect due to improper coating of the developer is liable to occur. On the other hand, when the amount of the developer circulating in the developing container becomes excessive, a proportion of the deteriorated toner having a long residence time is increased, so that an image density can vary and the image defect such as white background fog can occur. Further, a rotation resistance of the feeding screw member is increased, so that power consumption of the developing device is also increased. For this reason, as described in JP-A Hei 10-48937 and JP-A 2008-287079, control for keeping the amount of the developer circulating in the developing container in a predetermined range is effected.

Incidentally, when flowability of the circulating developer is lowered with temperature rise of the developer or an increase in residence time of the developer in the developing container, inconvenience accompanying the lower in flowability of the developer is caused. Further, in a developing device in which a pair of feeding screw members is vertically disposed (FIG. 2), compared with a developing device in which the pair of feeding screw members is horizontally disposed (FIG. 18), the inconvenience accompanying the developer flowability lowering is serious.

When the developer flowability changes, a discharge characteristic of the developer discharged from the developing device is changed. Generally, in the case where the flowability is high, the developer is liable to be discharged and in the case where the flowability is low, the developer is less liable to be discharged. In some cases, overflow of the developer is caused to occur. Particularly, as shown in FIG. 4, in the case of a developing device in which a developing chamber 23 and a stirring chamber 24 are provided so as to overlap each other with respect to a gravitational direction, when the flowability (of the developer) is lowered, it is difficult to push up the developer from the stirring chamber 24 to the developing chamber 23 through an opening 11. For this reason, the developer amount in the stirring chamber 24 becomes excessive. As a result, on a downstream side of the stirring chamber 24, developer overflow is liable to occur. Therefore, it can be considered that a height of the discharging portion is lowered and thus the developer is liable to be discharged in order to suppress the developer overflow even when the flowability is lowered. However, in the case of the above constitution, to the contrary, when the developer flowability is high, the developer is excessively discharged. As a result, the developer amount in the developing device is lowered, so that the improper coating of a developing sleeve is caused to occur.

SUMMARY OF THE INVENTION

A principal object of the present invention is to provide an image forming apparatus capable of suppressing a fluctuation in developer amount in a developing container even when a discharge characteristic of a developer in the developing container is changed by a change in flowability of the developer.

According to an aspect of the present invention, there is provided an image forming apparatus comprising:

an image bearing member for bearing a latent image;

a developing device, including a developer carrying member for carrying and feeding a developer including toner and a carrier to a developing position in which the developer opposes the image bearing member, for developing the latent image formed on the image bearing member;

a discharging portion for permitting discharge of an excessive developer present in the developing device by supplying the developer into the developing device;

a feeding member for feeding the developer in the developing device;

a controller for controlling a forced discharging operation for discharging the excessive developer from the discharging portion by changing a driving condition of at least one of the developer carrying member and the feeding member; and detecting means for detecting information correlating to flowability of the developer in the developing device, wherein the controller is capable of controlling the forced discharging operation on the basis of a detection result of the detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. The present invention can also be carried out in other embodiments in which a part or all of constitutions of the following embodiments are replaced with alternative constitutions so long as a developer is forcedly discharged from a developing container when flowability of the developer is lowered.

Therefore, when an image forming apparatus includes a developing device using the developer, the direction can be carried out even in image forming apparatuses of a tandem type and a one-drum type and can also be carried out irrespective of their types such as an intermediary transfer type, a recording material conveying type, or a direct transfer type in which a toner image is transferred onto a recording material sheet by sheet. In the following embodiments, only a major part of the image forming apparatus relating to formation and transfer of the toner image will be described but the present invention can be carried out in various fields of apparatuses or machines such as printers various printing machines, copying machines, facsimile machines, and multi-function machines.

Incidentally, general matters of the image forming apparatuses described in JP-A Hei 10-48937, JP-A 2004-206088, and JP-A 2008-287079 will be omitted from illustration and redundant explanation.

<Image Forming Apparatus>

Figure 1:
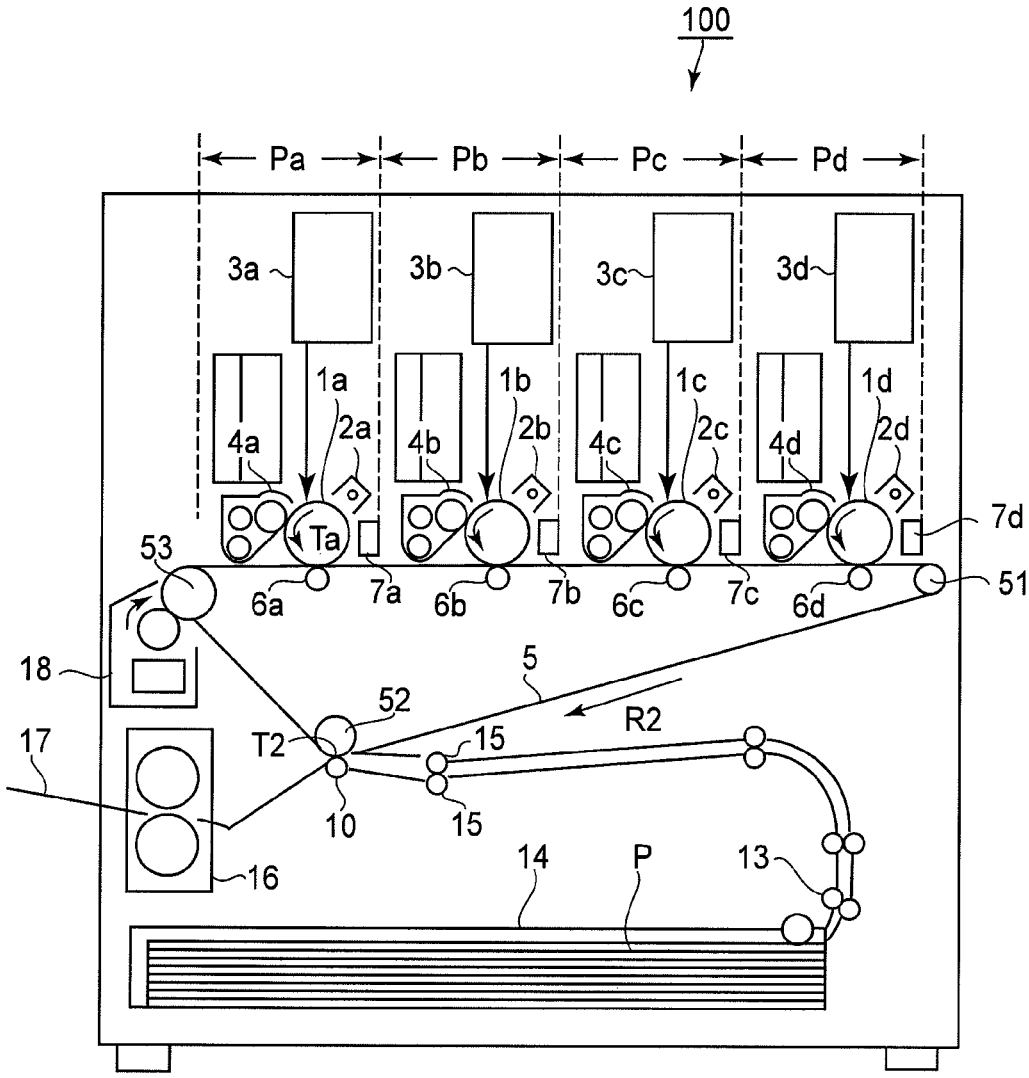
FIG. 1 is an illustration of a structure of an image forming apparatus.

FIG. 1 is an illustration of a structure of an image forming apparatus 100. As shown in FIG. 1, the image forming apparatus 100 is an intermediary transfer type full-color printer of the tandem type in which image forming portions Pa for yellow, Pb for magenta, Pc for cyan, and Pd for black are disposed along an intermediary transfer belt 5.

At the image forming portion Pa, a yellow toner image is formed on a photosensitive drum 1*a* and then is primary-transferred onto the intermediary transfer belt 5. At the image forming portion Pb, a magenta toner image is formed on a photosensitive drum 1*b* and then is primary-transferred superposedly onto the yellow toner image on the intermediary transfer belt 5. At the image forming portions Pc and Pd, a cyan toner image and a black toner image are formed on a photosensitive drum 1*c* and a photosensitive drum 1*d*, respectively, and are similarly primary-transferred superposedly onto the intermediary transfer belt 5.

The four color toner images primary-transferred on the intermediary transfer belt 5 are conveyed to a secondary transfer portion T2, at which the four color toner images are collectively secondary-transferred onto a recording material P. The recording material P on which the four color toner images are secondary-transferred subjected to application of heat and pressure in a fixing device 16 and thus the toner images are fixed on a surface of the recording material P. Thereafter, the recording material P is discharged on a stacking tray 17.

The intermediary transfer belt 5 is stretched around a tension roller 53, a driving roller 51 and an opposite roller 52 and is driven by the driving roller, thus being rotated at a process speed of 300 mm/sec in a direction indicated by an arrow R2.

The recording material P pulled out from a recording material cassette 14 is separated by a separation roller 13 one by one and is fed toward registration rollers 15. The registration rollers 15 receive the recording material P in a rest state and place the recording material P in a stand-by state and then feed the recording material P toward the secondary transfer portion T2 while timing the recording material P to the toner images on the intermediary transfer belt 5.

A secondary transfer roller 10 contacts the intermediary transfer belt 5 supported by the opposite roller 52 at an inner surface of the belt 5 to form the secondary transfer portion T2. A DC voltage of a positive polarity is applied to the secondary transfer roller 10, so that the (four color) toner images which have been negatively charged and carried on the intermediary transfer belt 5 are secondary-transferred onto the recording material P.

The image forming portions Pa, Pb, Pc and Pd have the substantially same constitution except that the colors of toners of yellow for a developing device 4*a* provided at the image forming portion Pa, of magenta for a developing device 4*b* provided at the image forming portion Pb, of cyan for a developing device 4*c* provided at the image forming portion Pc, and of black for a developing device 4*d* provided at the image forming portion Pd are different from each other. In the following description, the image forming portion Pa will be described and with respect to other image forming portions Pb, Pc and Pd, the suffix a of reference numerals (symbols) for representing constituent members (means) for the image forming portion Pa is to be read as b, c and d, respectively, for explanation of associated ones of the constituent members for the image forming portions Pb, Pc and Pd.

At the image forming portion Pa, around the photosensitive drum 1*a* as an example of an image bearing member, a corona charger 2*a*, an exposure device 3*a*, the developing device 4*a*, a primary transfer roller 6*a* and a cleaning device 7*a* are disposed. The photosensitive drum 1*a* includes an aluminum cylinder and a negatively chargeable photosensitive layer formed on outer peripheral surface of the aluminum cylinder and is rotated at a process speed of 300 mm/sec in an arrow direction.

The photosensitive drum 1 is irradiated with charged particles accompanying corona discharge by the corona charger 2*a*, so that the surface of the photosensitive drum 1*a* is electrically charged uniformly to a negative-polarity dark portion potential VD. The exposure device 3*a* writes (forms) a latent image for an image on the charged surface of the photosensitive drum 1*a* by scanning of the charged surface through a rotation mirror with a laser beam obtained by ON-OFF modulation of scanning line image data expanded from a separated color image for yellow. The developing device 4*a* deposits the toner on the latent image (exposed portion) on the photosensitive drum 1*a* by using the developer to reversely develop the latent image into the toner image as described later.

The primary transfer roller 6*a* urges the inner surface of the intermediary transfer belt 5 to form a primary transfer portion Ta between the photosensitive drum 1*a* and the intermediary transfer belt 5. By applying a positive-polarity DC voltage to the primary transfer roller 6*a*, the negative-polarity toner image carried on the photosensitive drum 1*a* is primary-transferred onto the intermediary transfer belt 5 which passes through the primary-transfer portion Ta.

The cleaning device 7*a* rubs the photosensitive drum 1*a* with a cleaning blade to collect transfer residual toner remaining on the photosensitive drum 1*a* without being transferred onto the intermediary transfer belt 5. A belt cleaning device 18 rubs the intermediary transfer belt 5 with a cleaning blade to collect the transfer residual toner which has passed through the secondary transfer portion T2 without being transferred onto the recording material and which remains on the intermediary transfer belt 5.

<Developing Device>

Figure 2:
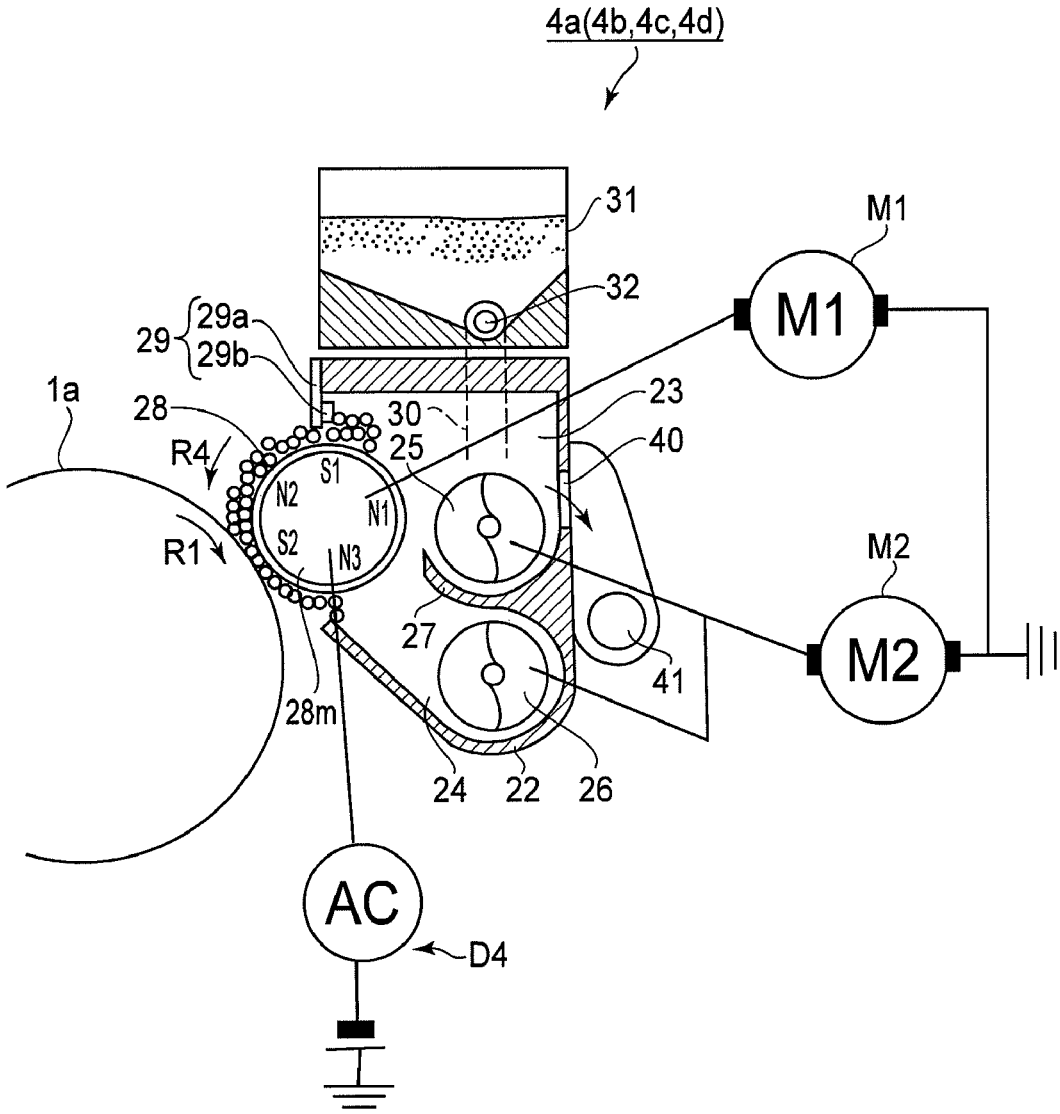
FIG. 2 is an illustration of a developing device.
Figure 3:
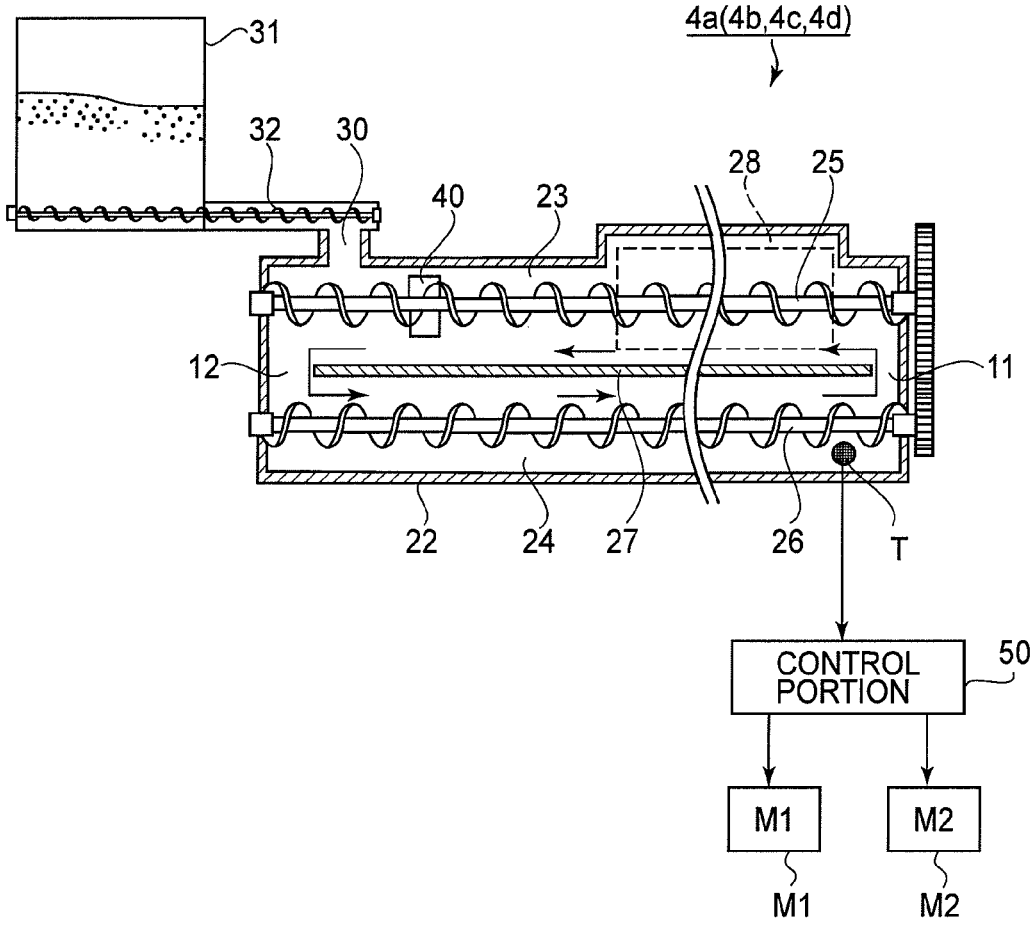
FIG. 3 is an illustration of a developer circulating path formed in a developing container.

FIG. 2 is an illustration of a structure of the developing device. FIG. 3 is an illustration of a developer circulating path formed in the developing container.

As shown in FIG. 2, the developing device 4*a* is of a so-called vertical stirring type in which a first feeding screw member 25 and a second feeding screw member 25 circulate the (two component) developer in a developing container 22. The first feeding screw member 25 feeds the developer in its longitudinal direction while supplying the developer to a developer carrying member (developing sleeve) 28. The second feeding screw member 26 feeds the developer, which has been collected from the developer carrying member 28, in a direction opposite from the developer feeding direction of the first feeding screw member 25. As shown in FIG. 3, a discharging portion in which the fed developer has passed through the developer carrying member 28 along the first feeding screw member 25 with respect to the developer feeding direction of the first feeding screw member 25.

The developing device 4*a* stirs and electrically charges the developer in the developing container 22 and carries the developer on the developing sleeve (developer carrying member) 28 in an erected chain state, thus rubbing the photosensitive drum 1*a* with the developer. By applying an oscillating voltage in the form of a DC voltage biased with an AC voltage, to the developing sleeve 28, the negatively charged toner is transferred onto the exposed portion of the photosensitive drum 1*a* which is positive relative to the toner, so that the latent image is reversely developed.

In the developing container 22, the (two component) developer containing the yellow toner (non-magnetic) and the magnetic carrier as a main component is filled in a predetermined amount. In a hopper 31 as an example of a supplying device, a developer for supplying in which the magnetic carrier is mixed in the yellow toner is filled and supplies the toner, in an amount corresponding to that of the toner used for image formation, into the developing device 4*a*. As a result, a toner content or concentration which is a weight ratio of the toner to the developer (T/D ratio) in the developing device 4*a* is kept in a predetermined range.

At an opening of the developing container 22 provided at a position (developing position) in which the developing sleeve 28 opposes the photosensitive drum 1*a*, the developing sleeve 28 is disposed rotatably while being partly exposed toward the photosensitive drum 1*a* side. The developing sleeve 28 is constituted by a non-magnetic material such as aluminum or stainless steel and has a diameter of 20 mm. The photosensitive drum 1*a* has a diameter of 30 mm. At the developing position in which the developing sleeve 28 opposes the photosensitive drum 1*a*, an opposing distance between the developing sleeve 28 and the photosensitive drum 1*a* is set at about 300 μm.

The inside of the developing container is vertically partitioned by a partition wall 27 into a developing chamber 23 provided with the developing sleeve 28 and a stirring chamber 24 communicating with the developing chamber 23 at their (longitudinal) end portions. As a stirring and feeding means for the developer, the feeding screw (member) 25 is disposed in the developing chamber 23 and the feeding screw (member) 26 is disposed din the stirring chamber 24.

The feeding screw 25 as an example of a feeding member is disposed substantially in parallel to an axial direction of the developing sleeve 28 at a bottom portion of the developing chamber 23 and feeds the developer in the developing chamber 23 in one direction with respect to its longitudinal direction. On the other hand, the developing sleeve 26 as an example of the feeding member is disposed substantially in parallel to the axial direction of the developing sleeve 28 and feeds the developer in the developing chamber 23 in an opposite direction to the feeding direction of the feeding screw 25.

Inside the developing sleeve 28, a magnet roller 28*m* is fixedly disposed non-rotatably. The magnet roller 28*m* has a developing pole (magnetic pole) S2 disposed to oppose the photosensitive drum 1*a* at the developing position, a magnetic pole S1 disposed to oppose a regulating blade 29, and a magnetic pole N2 disposed between the magnetic poles S1 and S2. The magnet roller 28*m* further has magnetic poles N1 and N3 disposed to oppose the developing chamber 23 and the stirring chamber 24, respectively.

At a position close to the opening of the developing chamber 23, the regulating blade 29 is disposed opposite to the developing sleeve 28. The regulating blade 29 is constituted by boding a non-magnetic member 29 formed of an aluminum plate material disposed along the longitudinal direction of the developing sleeve 28 and a magnetic member 29 of iron together. The regulating blade 29 is provided upstream of the photosensitive drum 1*a* with respect to the rotational direction of the developing sleeve 28, so that the developer passes between an end portion of the regulating blade 29 and the developing sleeve 28 and is fed to the developing position.

By adjusting the opposing distance between the regulating blade 29 and the developing sleeve 28, a cut amount of the chain of a magnetic brush of the developer carried on the developing sleeve 28 is regulated, so that the amount of the developer fed to the developing position is adjusted. The distance between the regulating blade 29 and the developing sleeve 28 may be set at 200-800 μm, preferably 300-500 μm. In this embodiment, the distance is set at 400 μm, so that a coating amount per unit area of the developer on the developing sleeve 28 is regulated at 25 mg/cm$^2$.

The developing sleeve 28 carries and feeds the developer, which has been subjected to layer thickness regulation by the regulating-blade 29, in the erected chain state during the development, and rotates in the present invention indicated by an arrow R4. The developing sleeve 28 rotates in the same direction as the rotational direction of the photosensitive drum 1*a*, and a peripheral speed ratio thereof to the photosensitive drum 1*a* is 1.75. The peripheral speed ratio may be set in the range of 0.5-3.0, preferably in the range of 1.0-2.0. This is because with respect to the peripheral speed of the developing sleeve 28, a development efficiency is increased with a higher peripheral speed but an excessively high peripheral speed causes problems of toner scattering, deterioration of the developer by the regulating blade 29, and the like.

To the developing sleeve 28, an oscillating voltage in the form of a DC voltage Vdc of −500 V biased with a rectangular AC voltage having a peak-to-peak voltage Vpp of 1800 V and a frequency f of 12 kHz is applied from a power source D4. Generally, in a two component magnetic brush developing method, when the AC voltage is applied, the development efficiency is increased and thus the image has a high quality but on the other hand, a fog is liable to occur. For this reason, the fog is prevented by providing a potential difference (fog-removing contract Vcont) between the DC voltage Vdc applied to the developing sleeve 28 and the charge potential (dark portion potential VD) of the photosensitive drum 1*a*. However, with respect to the voltage applied to the developing sleeve 28, the DC voltage value, the AC voltage value and the waveform are not limited to those described above.

<Two Component Developer>

The developer (two component developer) contains the toner and the magnetic carrier as the main component. The toner is a negatively chargeable polyester-based resin and may preferably have a volume-average particle size of 4 μm or more and 10 μm or less. In order to improve dot reproducibility on the image, the particle size may preferably be 8 μm or less and therefore in this embodiment, the toner having the particle size of 5.5 μm was used. The toner is prepared by externally adding an external additive such as colloidal silica to colored resin particles containing a binder resin, a colorant and other additives.

Further, in the toner, in order to suppress offset (deposition) in the fixing device 16, paraffin wax is added. An addition amount of the wax was 5 wt. parts. As the type of the wax, it is possible to use purified normal paraffin, ester wax, paraffin, polyethylene, polypropylene, and the like. It is also possible to use a blend of those waxes arbitrarily.

For measurement of the volume-average particle size of the toner, a Coulter Counter T-II (mfd. by Coulter Co. Ltd.) was used. Further, an interface (mfd. by Nikkaki Bios Co., Ltd.) for outputting number-average distribution and volume-average distribution and a personal computer (Model "CX-1", available from Canon K.K.) were used. As an electrolytic solution for a measurement sample, 1%-aqueous NaCl solution prepared by using reagent-grade sodium chloride was used.

To 100-150 ml of the electrolytic solution, 0.1 ml of a surfactant as a dispersant, preferably, alkylbenzenesulfonic acid salt, was added, and to this mixture, 0.5-50 mg of the measurement sample was added. Then, the electrolytic solution in which the measurement sample was suspended was subjected to dispersion in an ultrasonic dispersing device for about 1-3 minutes and thereafter was set in the Coulter Counter TA-II. Then, the particle size distribution of the toner particles, the size of which is in the range of 2-40 μm was measured with the use of the above-mentioned Coulter Counter TA-II fitted with a 100 μm aperture, and volume-average distribution was obtained. Then, a volume-average particle size was obtained from the thus-obtained volume-average distribution.

As the magnetic carrier, it is possible to use magnetic particles of iron, the surface of which has been oxidized or has not been oxidized, nickel, cobalt, manganese, chrome, rare-earth metals, alloys of the preceding metals, or oxide ferrite. The method of producing the magnetic particles is not particularly limited. The volume-average particle size of the magnetic carrier may be in the range of 20-60 μm, preferably, 30-50 μm. The magnetic carrier may be not less than $10^7$ ohm·cm, preferably, not less than $10^8$ ohm·cm, in resistivity. In this embodiment, the magnetic carrier has the volume-average particle size of 40 μm and has the resistivity of $5\times10^8$ ohm·cm.

The resistivity of the magnetic carrier was measured by using a cell of the sandwich type with a measurement electrode area of 4 cm$^2$ and an electrode gap of 0.4 cm. A voltage E (V/cm) was applied between two electrodes of the cell under application of 1 kg of weight (load), to measure the resistivity of the carrier from the amount of the current which passed through the circuit.

The volume-average particle size of the magnetic carrier was measured in such a manner that particles in the range of 0.5-350 μm were divided into 32 portions logarithmically on a volume basis by using a laser different-type particle size measuring apparatus ("HEROS", mfd. by Nippon Denshi K.K.). A median diameter providing 50% of volume was determined as the volume-average particle size) from a result of a count of the number of the particles in each of channels.

Incidentally, in the image forming apparatus for forming a full-color image by an electrophotographic process, from the viewpoints of coloring property and color-mixing property, the developer containing the toner and the magnetic carrier in mixture is used in the developing device. In the case where the two component developer is used, electric charges are imparted to the toner by triboelectric charge between the magnetic carrier and the toner, and the charge-imparted toner is electrostatically deposited on the latent image to form a toner image. For that reason, it is necessary to alleviate the lowering in charge-imparting ability of the magnetic carrier.

The developing device 4*a* suppresses the charge-imparting ability lowering of the magnetic carrier by supplying the developer for supply containing 10% of the magnetic carrier. Further, the developer for supply containing the magnetic carrier is supplied into the developing container 22, while the excessive developer in the developing container 22 by the supply is discharged from the discharging portion 40 provided at the wall surface of the developing container 22 and is collected.

However, when an image forming process of an original having a low print ratio is performed in many cases, a charging performance or flowability of the developer can be largely lowered. This is because the external additive contained in the toner for controlling the electric charges or the flowability is separated or embedded in the toner surface by the stirring or sliding by the feeding screws 25 and 26 or by the sliding with the regulating member 29. As a result, by the improper discharge through the discharging portion 40, the excessive developer is increased in the developing container 22 and overflows from the developing device 4*a*, thus contaminating the output image in some cases.

On the other hand, when the flowability is increased for some reason, the developer is excessively discharged and the developer amount in the developing container 22 is decreased, so that a sufficient amount of the developer cannot be supplied to the developing sleeve 28. For this reason, improper coating occurs and image density non-uniformity occurs in some cases.

In order to solve the above-described problems, optimization of design of the developer discharging portion or the feeding screw has been conventionally carried out exclusively. For example, in JP-A Hei 10-48937, the discharging portion provided with a shutter member at the wall surface of the developing container is described. Further, in JP-A 2004-206088, a constitution in which feeding power of the feeding screw in the neighborhood of the discharging portion is made larger than those in areas downstream and upstream of the discharging portion with respect to the developer feeding direction is proposed.

However, in the constitution in JP-A Hei 10-48937, an operating (driving) motor for opening and closing the shutter is needed and therefore a developing device constitution is complicated, so that the entire developing device is increased in sized by any means. Further, it is difficult to discharge a slight (trace) amount of the discharger with accuracy by using the shutter or the like, so that the developer amount in the developing container 22 cannot be stably retained.

Further, in the constitution in JP-A 2004-206088, a difference in feeding power of the feeding screw (member) with respect to the feeding direction is provided in the neighborhood of the discharging portion, so that a stagnation portion of the developer is created in the neighborhood of the discharging portion. At this stagnation portion, the surface of the developer is not stabilized and therefore at the discharging portion, unstable discharge is repeated.

Thus, in the constitutions in JP-A Hei 10-48937 and JP-A 2004-206088, it was difficult to prevent the developer overflow or the image density non-uniformity. Further, as a factor of the developer flowability change which was not described in JP-A Hei 10-48937, JP-A 2004-206088 and JP-A 2008-287079, it has been that there is a temperature characteristic of the developer. Further, it has been also found that the developer discharge characteristic is considerably changed in the case where the mode of the process speed is switched to a low speed mode for effecting the image formation on thick paper.

Therefore, even in the case where the discharge characteristic of the developer is changed by the flowability change of the developer or by the switching of the process speed, it is desired that the discharge characteristic necessary for the developer is ensured to suppress the developer overflow or the image density non-uniformity.

<Supply of Developer for Supply and Discharge of Developer>

Figure 4:
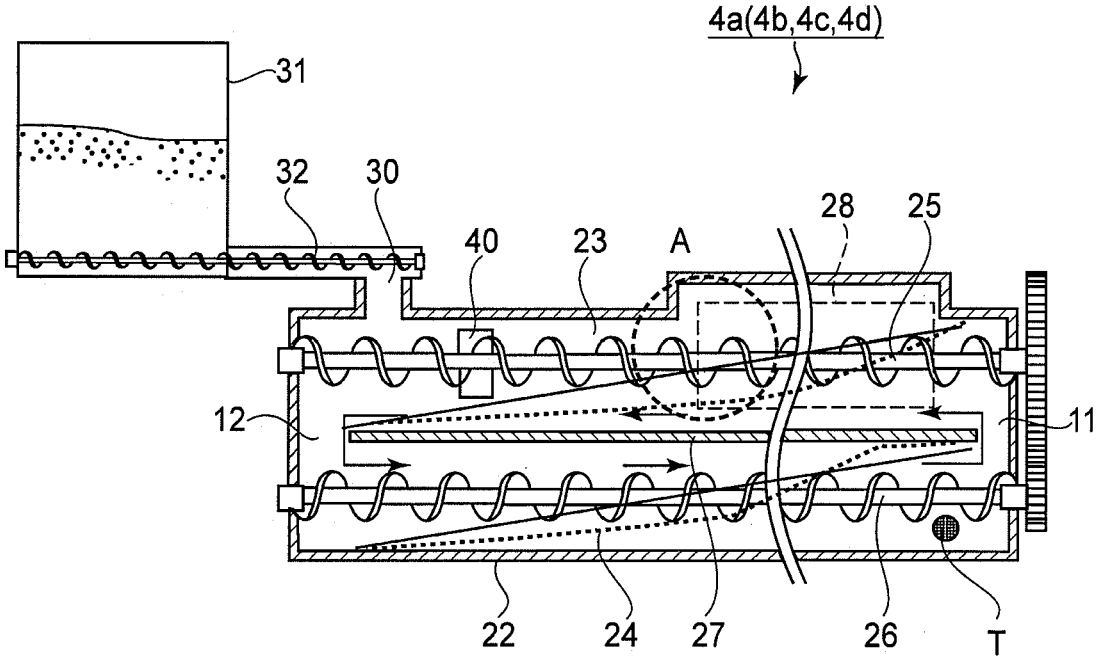
FIG. 4 is an illustration of a circulating state of the developer in the developing container.

FIG. 4 is an illustration of a circulating state of the developer in the developing container. As shown in FIG. 4, when the feeding screws 25 and 26 are rotated, the developer is fed and transferred through the openings 11 and 12 at both end portions of the partition wall 27 and circulates between the developing chamber 23 and the stirring chamber 24. Each of the feeding screws 25 and 26 is 18 mm in diameter and 20 mm in pitch and is rotated at the rotation number of 750 rpm during normal image formation.

Above the developing device 4*a*, the hopper 31 which accommodates the developer for supply containing the toner in which the magnetic carrier is mixed in the weight ratio of 10% is disposed. The hopper 31 as an example of the supplying device is provided with a supplying screw 32 at its lower portion, and an end of the supplying screw 32 extends to a position of a supply opening 30 provided at a front end portion of the developing device 4*a*.

When the developer for supply is supplied into the developing container 22 while passing through the supply opening 30, the toner in an amount corresponding to the consumed toner during preceding image formation is supplied into the developing device 4*a* and at the same time, a fresh magnetic carrier is also supplied.

The supply amount of the developer for supply is changed depending on an outer diameter, a pitch and an angle of rotation of the supply screw 32. In this embodiment, in order to stabilize the supply amount, a rotary encoder is attached to the supply screw 32 and the developer amount corresponding to one rotation (one block) of the supply screw 32 is taken as one supply unit of the developer for supply.

That is, simultaneously with the image formation, an exposure signal for each color is integrated to obtain a toner consumption amount for each color, and the supply screw 2 is rotated through one full circumference every time when the toner consumption amount reaches the toner amount of one supply unit of the developer for supply.

Incidentally, control of the supply amount of the developer for supply may also be combined with control such that the toner content (toner/developer (T/D) ratio) is optically or magnetically detected and the supply/amount is adjusted so as to keep the toner content at a constant level.

Further, it is also possible to combine the supply amount control of the developer for supply with control such that a patch image is formed on the photosensitive drum 1*a* under a predetermined exposure condition and optical reflected light of the patch image is detected to measure the amount of the toner per unit area and then the supply amount is adjusted so that the toner amount per unit area of the patch image is brought near to a reference value.

At an inner wall surface of the developing chamber 23, the discharging portion 40 for permitting discharging of the developer which becomes excessive in the developing container 22 is provided. By the rotation of the feeding screw 25, a part of the developer fed in the developing chamber overflows from the discharging portion 40 and is discharged from the developing container 22. In order that the developer for supply supplied through the supply opening 30 is not discharged immediately through the discharging portion 40, the discharging portion 40 is disposed on an upstream side of the supply opening 30 with respect to the feeding direction of the feeding screw 25.

When the developer for supply is supplied from the hopper 31 and the developer amount in the developing container 22 is increased, the developer in the amount corresponding to the increased developer amount is discharged through the discharging portion 40. As shown in FIG. 2, the developer discharged through the discharging portion 40 is fed to the rear side of the image forming apparatus and is conveyed to and collected in a waste toner container (not shown).

As shown in FIG. 4, in the developing chamber 23 of the developing device 4*a*, the feeding screw 25 supplies a pair of the developer to the developing sleeve 28 while feeding the developer in its longitudinal direction. On the other hand, the developer coated on the developing sleeve 28 passes through the developing position in which the developing sleeve 28 opposes the photosensitive drum 1*a* and thereafter is fed in the opposite direction to the feeding direction of the feeding screw 25 while being collected by the feeding screw 26.

In the developing device 4*a*, during the normal image formation, the developer circulates in the developing container 22 in a state in which the developer surface is inclined with respect to the longitudinal direction as indicated by solid lines in FIG. 4. In the stirring chamber 24, there is a tendency that the developer amount is increased toward the downstream side with respect to the feeding direction of the feeding screw 26 to raise the developer surface. In the developing chamber 23, on the contrary, there is a tendency that the developer amount is decreased through the downstream side with respect to the feeding direction of the feeding screw 25 to lower the developer surface. Further, the slope of the developer surface varies depending on flowability (agglomerating property) and when the flowability of the developer is lowered, the slope of the developer surface is increased as indicated by dotted lines in FIG. 4.

When the flowability of the developer is lowered, an efficiency of raising of the developer from the stirring chamber 24 to the developing chamber 23 through the opening 11 is lowered, so that the amount of the developer stagnating in the stirring chamber 24 is increased and the amount of the the consumed toner, so that the developer amount in the developing container 22 becomes excessive. However, the developer surface is fluctuated by the rotation of the feeding screw 23, so that the discharging of the developer from the discharging portion 40 is continued even in the inclined state of the developer indicated by the dotted line. However, a discharge level of the developer discharge is lowered and therefore the developer in the amount corresponding to the increased developer amount by the supply cannot be discharged.

In this case, the developer is stagnated and subjected to pressure application in the neighborhood of the opening 11 in the stirring chamber 24, so that a rotation resistance of the feeding screw 26 is increased and therefore deterioration of the developer by pressure stirring is accelerated.

Further, when the developer stagnating on the (feeding direction) downstream side in the stirring chamber 24 is excessively increased, on the downstream side in the stirring chamber 24, the developer carried on the developing sleeve 28 and subjected to the development cannot be normally collected into the developing container 22. As a result, developer overflow such that the developer carried on the developing sleeve 28 is dropped to the outside of the developing container 22 as it is and is scattered over the intermediary transfer belt 5 occurs in some cases.

In Embodiment 1 described below, when a developer flowability lowering condition is satisfied, control does not rely on natural overflow of the developer through the discharging portion 40. Instead thereof, the image formation is stopped and the feeding screws 25 and 26 are rotated at higher speed than a normal speed, so that a forced discharging mode in which the excessive developer is forcedly discharged quickly from the discharging portion 40 is executed. By rotating the feeding screws 25 and 26 at high speed, the raising efficiency of the developer from the stirring chamber 24 to the developing chamber 23 through the opening 11 is increased, so that the stagnation of the developer in the neighborhood of the opening 11 in the stirring chamber 24 is eliminated. By rotating the feeding screw 25 at the higher speed than the normal speed, the developer surface passing through the discharging portion 40 is raised, so that the develop discharging through the discharging portion 40 is promoted.

Embodiment 1

Figure 5:
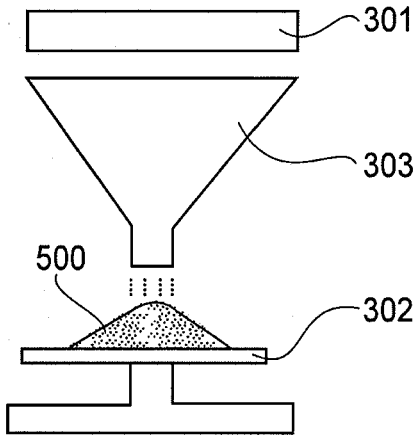
FIG. 5 is an illustration of measurement of angle of repose of the developer.
Figure 6:
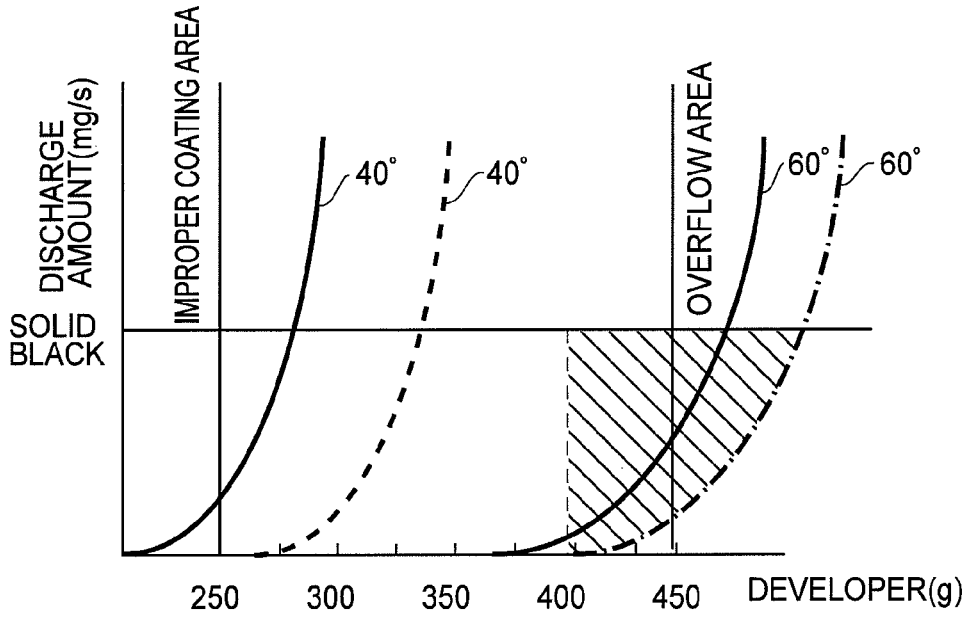
FIG. 6 is an illustration of a discharge characteristic of the developer in the developing device.

FIG. 5 is an illustration of measurement of angle of repose. FIG. 6 is an illustration of the developer discharge characteristic in the developing device.

In Embodiment 1, the flowability (agglomerating property) of developers different in condition was evaluated by measuring an angle of repose ϕ of the developer at the base portion of the pile of the developer deposited in a conical shape. The angle of repose ϕ was measured by using a measuring device ("POWDER TESTER PT-N", mfd. by HOSOKAWA MICRON CORPORATION) in accordance with measurement of angle of repose in an operation manual of the measuring device. As shown in FIG. 5, a screen 301 is set with an aperture of 710 μm, a vibration time of 180 seconds, and an amplitude of 2 mm. The developer is dropped on a disk 302 from a funnel 303. An angle formed between the generatrix of a developer (toner) 500 deposited in the conical shape on the disk 302 and the surface of the disk 302 was obtained as the angle of repose ϕ

In Embodiment 1, the idling of the yellow developing device 4*a* was performed for 1 hour in a constant-temperature oven in which the temperature is changed at 4 levels of 20° C., 30° C., 40° C., and 50° C. with a constant absolute water (moisture) content. Thereafter, the developer was taken out of the developing device 4*a* and subjected to the measurement of the angle of repose. The idling of the developing device 4*a* was performed under the same condition as that of the image forming apparatus described above. A result of the measurement of the angle of repose is shown in Table 1.

TABLE 1

| Temp. | 20° C. | 30° C. | 40° C. | 50° C. |
|---|---|---|---|---|
| Initial | 40 | 42 | 45 | 50 |
| 60 min. | 42 | 45 | 50 | 60 |

As shown in Table 1, the flowability of a fresh developer (initial) depends on the temperature, so that the angle of repose is large in a high-temperature environment and thus the flowability is lowered. This may be attributable to a phenomenon that the wax disposed in the neighborhood of the toner surface is liable to bleed to the toner surface and the agglomerating property between particles of the developer is increased. It has been confirmed that this tendency provides a large difference depending on the weight parts of the added wax, the type of the wax, and a melting point of the toner.

Then, by using the developer having the angle of repose obtained in the above-described experiment, the discharge characteristic of the developer in the developing device 4*a* was evaluated as shown in FIG. 6. In FIG. 6, the abscissa represents the weight of the developer and the ordinate represents a developer discharge amount per unit time through the discharging portion 40.

The developing device 4*a* has a developer amount of 330 g as a center value and is adjusted to have a weight ratio of the magnetic carrier to the developer for supply (C/D ratio) of 10%. Further, a supply amount of the developer for supply necessary for image formation of an A3-size solid image with a whole-area maximum density is 700 mg.

As shown in FIG. 6 with reference to FIG. 4, the developer discharge amount through the discharging portion 40 is, as described above, required to be controlled in a range in which the improper coating of the developing sleeve 28 due to the excessive lowering in develop surface in the developing chamber 23 is not caused to occur at the downstream portion A. In the developing device 4*a*, a lower limit of the developer amount at which the improper coating occurs is 250 g as indicated by a left-side vertical line. For this reason, even in a state in which the supply of the developer for supply is stopped due to continuation of the image formation of the image with a low image ratio (white background image), there is a need to ensure the developer amount of 250 g or more in the developing device 4*a*. That is, when the white background image formation is continued, it is required that the discharge amount is 0 mg and thus the developer amount is not 50 g or less.

Further, the developer discharge amount through the discharging portion 40 for permitting the discharging of the excessive developer in the developing device is also required to be controlled in a range in which the developer overflow due to an excessive increase in developer amount in the stirring chamber 24 is not caused to occur. In the developing device 4*a*, an upper limit of the developer amount at which the developer overflow occurs is 450 g as indicated by a right-side vertical line. For this reason, even in a state in which the supply amount of the developer for supply is maximum due to continuation of the image formation of the A3-size whole-area maximum density image as indicated by the solid black supply amount, there is a need that the developer amount in the developing container 22 does not exceed 450 g. That is, in the case where the image formation of the A3-size whole-area maximum density image is continued, it is required that the developer amount is retained at a value which is 450 g or less by performing the discharge of the developer at a rate of 98 mg/sheet through the discharging portion 40.

Incidentally, the developer discharge characteristic can also be adjusted by adjusting the height of the discharging portion 40 for permitting the discharging of the excessive developer in the developing device. Specifically, by lowering the height of the discharging portion 40, the developer is made liable to overflow and the developer amount in the developing device 4*a* is induced in a decreasing state (direction), so that the developer overflow can be suppressed. Further, by increasing the height of the discharging portion 40, the developer is made less liable to overflow and the developer amount in the developing device 4*a* is induced in an increasing state (direction), so that the improper coating can be suppressed.

However, in the developing device 4*a*, the developer having the angle of repose of 40 degrees providing high flowability is liable to be discharged through the discharging portion 40 and therefore the developer amount in the developing chamber 23 becomes insufficient, so that the improper coating occurs. On the other hand, the developer having the angle of repose of 60 degrees providing lowered flowability is less liable to be discharged through the discharging portion 40 and therefore the developer amount in the stirring chamber 24 becomes excessive, so that the developer overflow occurs. For this reason, on the premise that the developer is changed in flowability in the range of the angle of repose from 40 degrees to 60 degrees, there is no height of the discharging portion 40 capable of compatibly realizing prevention of the improper coating and prevention of the developer overflow, so that the problems of the improper coating and the developer overflow cannot be solved by the height of the discharging portion 40.

Therefore, in this embodiment, the height of the discharging portion 40 was set so as to provide the discharge characteristic indicated by a broken line in FIG. 6 in order not to cause the improper coating even with respect to the developer having the angle of repose of 40 degrees providing high flowability. In this case, compared with the case where the discharge characteristic indicated by a solid line, the developer amount in the developing device 4*a* is in the increasing state. For this reason, with respect to the developer having the angle of repose of 60 degrees providing lowered flowability, the developer overflow is liable to occur as indicated by a chain line in FIG. 6.

Therefore, the developer amount which exceeds 450 g to cause the developer overflow when the developer is left standing is kept away from 450 g by executing the forced discharging mode after the continuous image formation is interrupted, to forcedly discharge the developer from the developing container 22. By rotating the feeding screws 25 and 26 at high speed in a state in which the developing sleeve 28 is stopped, the developer surface in the developing chamber 23 is temporarily increased to cause the developer at a portion indicated by a hatched line in FIG. 6 to overflow from the discharging portion 40.

That is, the improper coating of the developing sleeve 28 occurs in the case where the developer amount in the developing container 22 is small. In order to prevent the improper coating, when the developer for supply containing the toner having a higher density than that of the circulating developer is supplied, the toner density in the developing device 4*a* is changed. Specifically, when the developer for supply corresponding to one block is supplied, the toner is supplied into the developing device 4*a* in an amount which is 90% of the supplied amount, so that the weight ratio of the toner to the developer (T/D ratio) is increased. Further, when the developer for supply is supplied in a state in which a print ratio is low and the toner is not consumed, the weight ratio of the toner to the developer is increased and thus the toner charge amount tends to lower, so that toner scattering or a lowering in image quality such as white background fog image.

Therefore, first, the height and length of the discharging portion 40 causing no improper coating were designed on the assumption that the developer has the angle of repose of 40 degrees providing high flowability. This height was found at a position (the broken line in FIG. 6) which is 10 mm higher than the position, indicated by the solid line in FIG. 6, in the conventional developing device 4*a*. However, as described above, when the height of the discharging portion 40 is increased by 10 mm, the discharge characteristic of the developer having the angle of repose of 60 degrees providing lowered flowability is further deteriorated (the chain line in FIG. 6).

Therefore, in this embodiment, in the case where the developer flowability is lowered and the discharge of the developer through the discharging portion 40 is expected not to be properly performed, the excessive developer is discharged in the forced discharging mode of the developer. During intentionally prepared non-image formation, the feeding speed of the normally used feeding screws 25 and 26 is increased, so that the developer is forcedly discharged through the discharging portion 40 used for the normal discharge.

<Temperature Detection>

Figure 7:
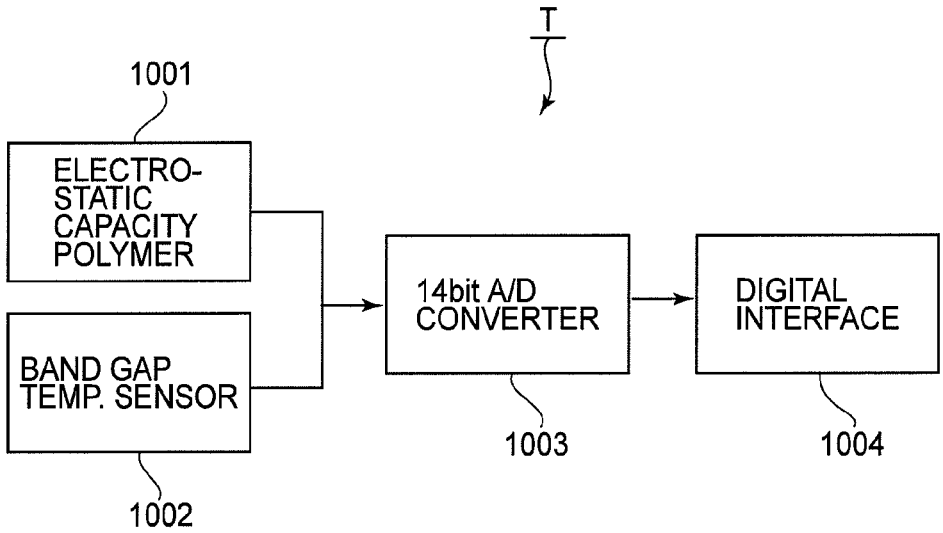
FIG. 7 is an illustration of a constitution for detecting temperature rise of a circulating developer.
Figure 8:
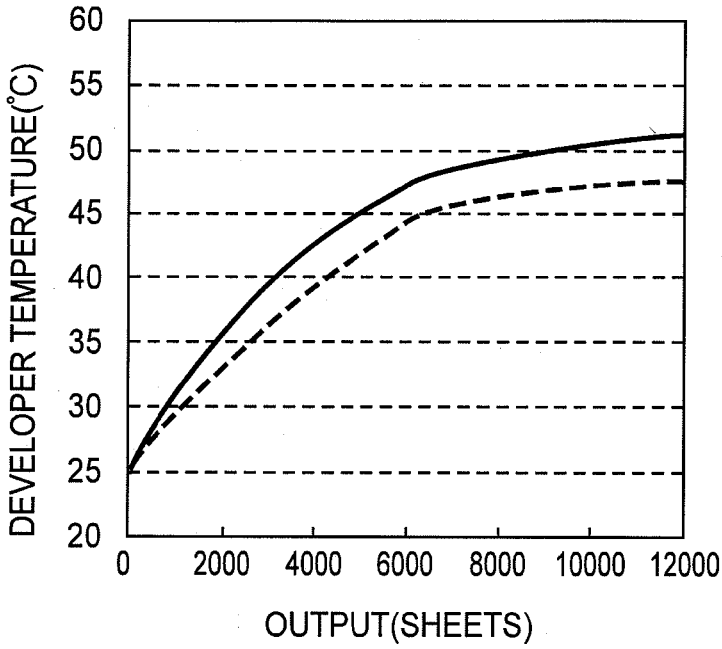
FIG. 8 is an illustration of the temperature rise of the developer accompanying cumulative image formation.

FIG. 7 is an illustration of a constitution for detecting temperature rise of the circulating developer. FIG. 8 is an illustration of the temperature rise of the developer accompanying cumulative image formation. In this embodiment, the temperature of the developer as an example of information correlating to the flowability of the developer is directly measured by providing a temperature detecting means T, so that the flowability of the developer is estimated (Table 1).

As shown in FIG. 3, a temperature/humidity sensor T as a detecting means is disposed so as to be exposed inside the developing container 22 in order to measure the temperature which is a contribution factor of a change in flowability of the developer. The disposition place of the temperature/humidity sensor T may desirably be a position in which a detecting portion of the temperature/humidity sensor T is to be buried in the developer in order to improve detection accuracy, so that the temperature/humidity sensor T was disposed in the neighborhood of the downstream-side opening 11 in the stirring chamber 24. In this embodiment, the temperature/humidity sensor T directly detect the temperature in order to realize maximum compatibility between productivity and image quality by enhancing estimation accuracy of the change in flowability of the developer to optimize the forced discharging mode of the developer. However, it is possible to estimate the developer temperature from an environment sensor, attached to the inside of the main assembly of the image forming apparatus, as a substitute for the temperature/humidity sensor As the temperature/humidity sensor T, a temperature/humidity sensor ("SHT1X series", mfd. by Sensirion Co., Ltd.) was used. As shown in FIG. 7, the temperature/humidity sensor T includes a sensing element 1001 of an electrostatic capacity polymer as a humidity detecting device and includes a band gap temperature sensor 1002 as a temperature detecting device. The temperature/humidity sensor T is a CMOS device in which outputs of the sensing element 1001 and band gap temperature sensor 1002 are coupled by an A/D converter 1003 and serial output is performed through a digital interface 1004. The band gap temperature sensor 1002 is constituted by a thermistor linearly changed in resistance value with respect to the temperature and the temperature is calculated from the resistance value.

The temperature/humidity sensor T includes the sensing element 1001 which is a capacitor in which the polymer is inserted as a dielectric member and also has a humidity detecting function of converting the electrostatic capacity into humidity by using a property such that the content of water which is adsorbed by the polymer is linearly changed depending on the humidity. However, in this embodiment, only the result of the temperature detection is utilized, so that the temperature/humidity sensor T may also be substituted by a thermistor element or the like capable of detecting only the temperature.

As shown in FIG. 8, the developer temperature is increased up to around 50° C. when the developer is circulated in the developing container 22 by the rotation of the feeding screws 25 and 26. In this embodiment, the image forming apparatus 100 is disposed in a fixed environment of the room temperature (25° C.) and a relative humidity of 50% RH, and A4 sized plain paper is sent with landscape orientation and is subjected to continuous image formation. In FIG. 8, the progression of a temperature measurement result of the temperature/humidity sensor T provided in the yellow developing device 4*a* (solid line) and the progression of a temperature measurement result of the temperature/humidity sensor T provided in the black developing device 4*d* (broken line) were shown. The abscissa represents the number of output sheets and the ordinate represents the measured temperature of the developer. A temperature rise characteristic varies depending on a self-temperature rise of each of motors in the image forming apparatus 100, a temperature rise characteristic in a casing by a heat source such as a drum heater (not shown) provide din the photosensitive drum 1*a* or the fixing device 16 or the like. Even when the disposition environment of the image forming apparatus 100 is kept constant (the room temperature of 25° C./the relative humidity of 50% RH), the state of the developer temperature rise varies. For this reason, the flowability of the developer is changed for each of the developing devices 4*a*, 4*b*, 4*c* and 4*d*, so that there is a need to optimize the forced discharging mode in each of the developing devices 4*a*, 4*b*, 4*c* and 4*d*.

In this embodiment, in order not to cause the developer overflow during the lowering in flowability of the developer, a control portion (controller) 50 controls the forced discharging mode by using a flowability change estimation table of the developer shown below.

TABLE 2

| Temp. | 20° C. | 30° C. | 40° C. | 50° C. |
|---|---|---|---|---|
| Yellow | 1.05 | 1.13 | 1.25 | 1.50 |
| Magenta | 1.04 | 1.09 | 1.17 | 1.44 |
| Cyan | 1.02 | 1.07 | 1.15 | 1.35 |
| Black | 1.01 | 1.04 | 1.12 | 1.27 |

The values in Table 2 are developer temperature-dependent values for the respective colors. Each of the values was shown as a change ratio of the angle of repose of the developer after 60 min.-idling to the angle of repose of the initial developer (specifically, the angle of repose of 40 degrees for the yellow developer) in a 20° C.-environment with respect to each of the colors. As is also apparent from Table 2, the flowability change estimation table varies depending on the color of the developer, a material constitution of the developer, a constitution of the developing device, and the like and therefore it is understood that the flowability change estimation table is required to be appropriately calculated and set.

<Stop of Developing Sleeve>

Figure 9:
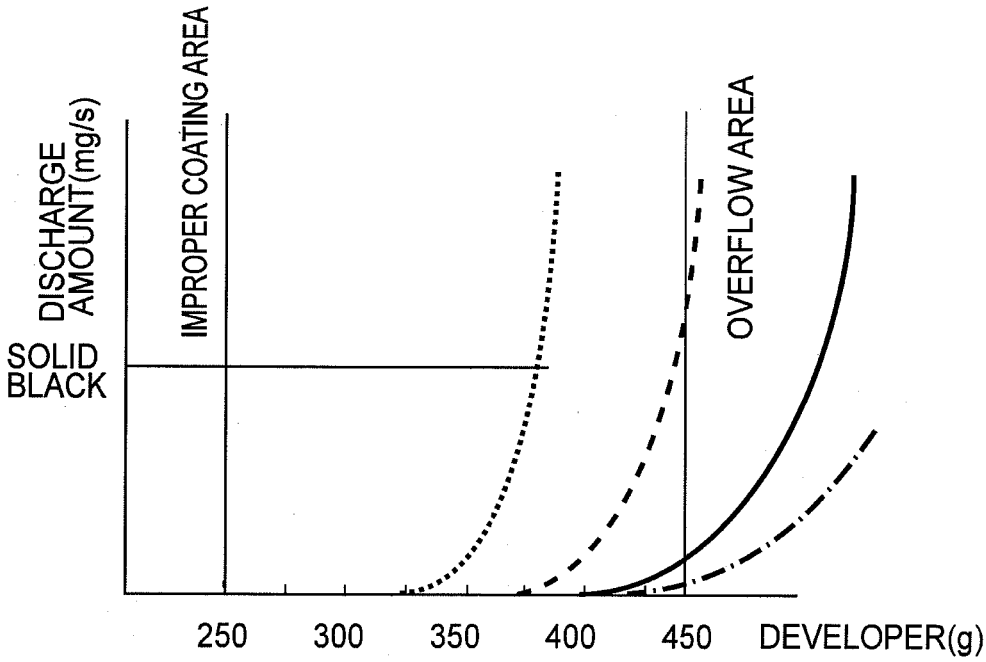
FIG. 9 is an illustration of an effect of stop of a developing sleeve in a forced discharging mode.

FIG. 9 is an illustration of an effect of the stop of the developing sleeve in the forced discharging mode. As shown in FIG. 3, in this embodiment, a constitution in which the developing sleeve 28 and the feeding screws 25 and 26 are connected with gears at portions outside the developing container 22 and are driven by the same motor as in the conventional developing device is not employed. In this embodiment, the developer carrying member (photosensitive drum) 28 driven by a separate motor M1 which is subjected to control of actuation and stop, independently of a motor for driving the feeding screw members 25 and 26. For this reason, the forced discharging mode in which the developer is forcedly discharged through the discharging portion 40 by increasing the feeding speed of the feeding screw member 25 is executable in a state in which the rotation of the developer carrying member (developing sleeve) 28 is stopped. By providing the driving motor M2 separately from the driving motor M1 for driving the developing sleeve 28, the feeding screws 25 and 26 are driven, so that the rotational speed of the developing sleeve 28, the rotational speed of the feeding screws 25 and 26 and their rotational speed ratio are arbitrarily settable. In the forced discharging mode, by rotating the feeding screw 25 in the state in which the developing sleeve 28 is stopped and the developer has its escape cut off, the height of the developer surface at the discharging portion 40 is efficiently increased to accelerate the overflow through the discharging portion 40. As a result, it is possible to forcedly discharge both of the toner and the carrier from the discharging portion 40.

In the forced discharging mode in this embodiment, the rotational speed of the feeding screws 25 and 26 was set at 900 rpm which is 1.2 times that (750 rpm) during the normal image formation. As a result, the developer surface is increased relative to the fixed discharging portion 40, so that the discharge amount of the developer through the discharging portion 40 is made larger than that during the normal image formation.

In this embodiment, an independent drive constitution in which the developing sleeve 28 and the feeding screws 25 and 26 can be independently driven is employed. For this reason, in the forced discharging mode, the driving motor M2 for the developing sleeve 28 was stopped and only the driving motor M1 was driven.

In order to confirm the effect of the drive of only the driving motor M2, by using the developer having the angle of repose of 60 degrees providing lowered flowability, a relationship between the rotational speed of the feeding screws 25 and 26 and the discharge characteristic of the developer through the discharging portion 40 was investigated. Four cases of the case where only the driving motor is rotated at the rotational speed of 600 rpm (chain line), the case of a normal discharge characteristic at the rotational speed of 750 rpm (solid line), the case where both of the driving motors M1 and M2 are simultaneously rotated at an increased rotational speed of 900 rpm (broken line) which is 1.2 times that (750 rpm) for the normal discharge characteristic, and the case where only the driving motor M2 is rotated at the increased rotational speed of 900 rpm (dotted line) which is 1.2 times that (750 rpm) for the normal discharge characteristic were compared.

As shown in FIG. 9, an effect of increasing the developer discharge amount through the discharging portion 40 in the case where only the driving motor M2 is driven at the rotational speed of 900 rpm (dotted line) is larger than that in the case where both of the driving motors M1 and M2 are simultaneously driven at the rotational speed of 900 rpm (broken line). Further, with respect to the cases of driving only the driving motor M2, when the rotational speed of the feeding screws 25 and 26 is 600 rpm (chain line) which is slower than 900 rpm (solid line) during the image formation, the effect of increasing the developer discharge amount through the discharging portion 40 is small.

In order to increase the developer discharge amount through the discharging portion 40, there is a need to increase the height of the developer surface in the neighborhood of the discharging portion 40 and for that purpose, it is desirable that the developer amount on the developing chamber 23 side is increased. For that purpose, there is a need to raise a larger amount of the developer toward the developing chamber 23 and an increase in rotational speed of the feeding screw 26 is effective. In this case, when the developing sleeve 28 is stopped, it is possible to suppress the amount of the developer to be supplied from the feeding screw 25 to the developing sleeve 28. For this reason, the developer surface is increased in height compared with the case where the developing sleeve 28 is rotated, so that the amount of the developer which reaches the discharging portion 40 is increased and thus the developer discharge amount is increased.

Control in Embodiment 1

Figure 10:
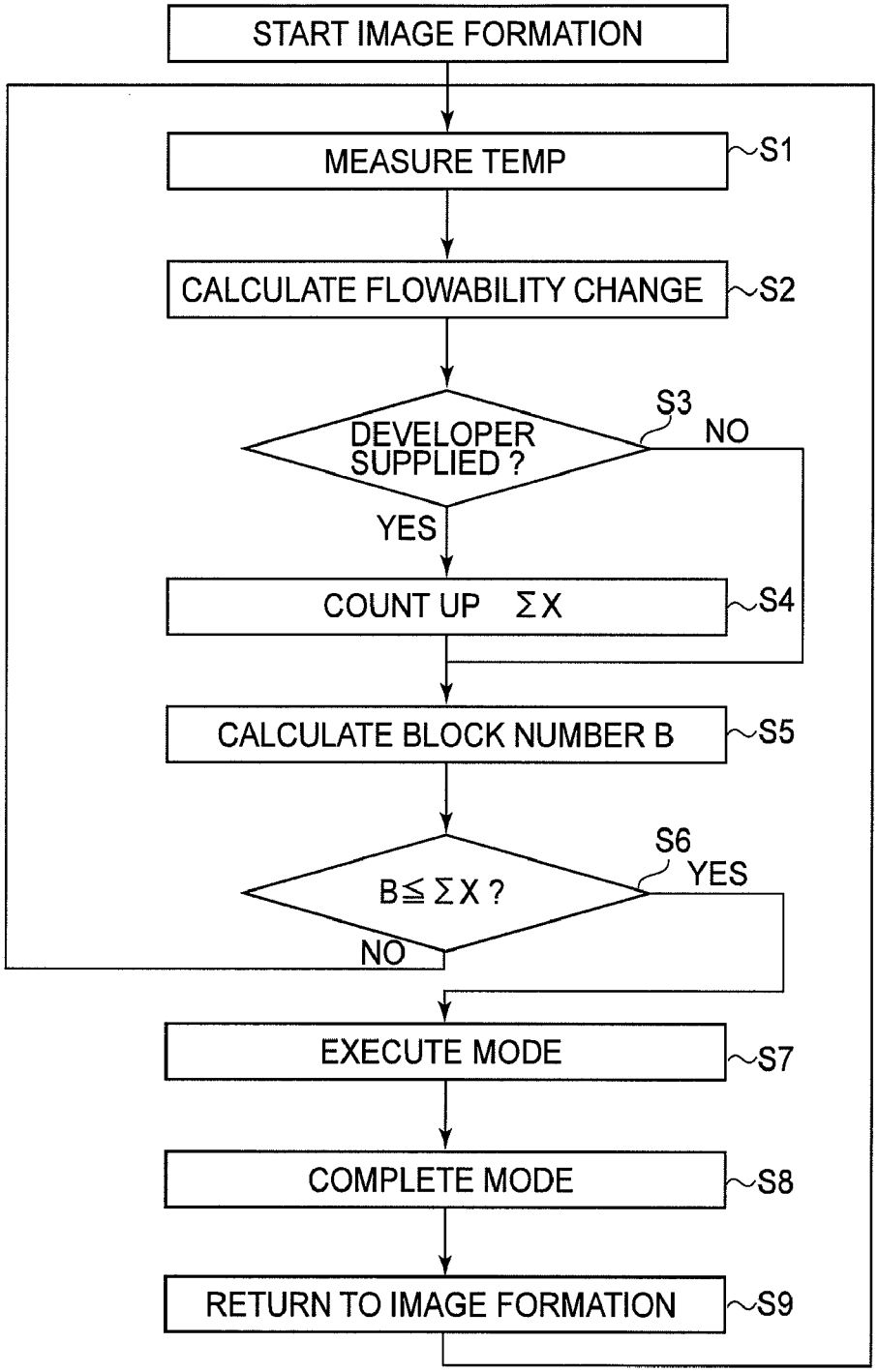
FIG. 10 is a flowchart of control in Embodiment 1.
Figure 11:
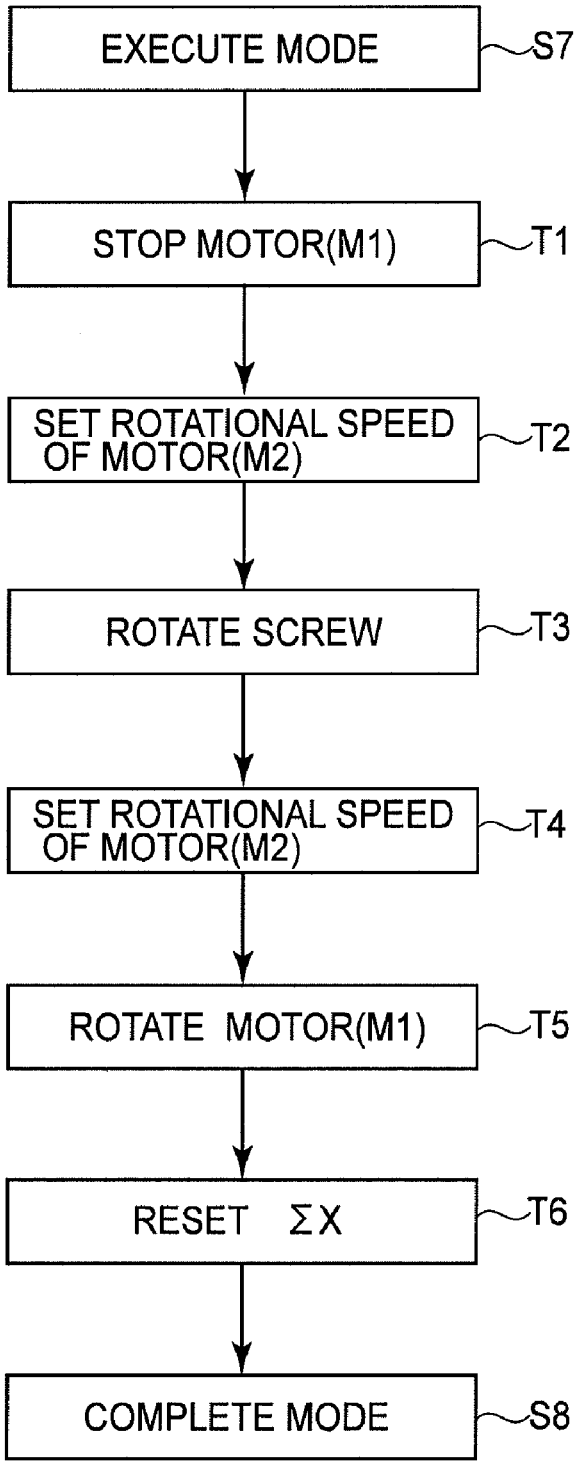
FIG. 11 is a flowchart of control in the forced discharging mode.

FIG. 10 is a flowchart of control in Embodiment 1. FIG. 11 is a flowchart of control in the forced discharging mode. As shown in FIG. 10 with reference to FIG. 3, when the image formation is started, the control portion (controller) 50 measures the temperature of the developer by the temperature/humidity sensor T disposed in the developing device 4*a* (S1).

Next, the control portion 50 calculates a flowability change amount of the developer at a current temperature by making reference to the flowability change estimation table of Table 2 on the basis of a measurement result of the temperature/humidity sensor T (S2).

Next, in the case where the developer for supply is supplied during the image formation (YES of S3), the control portion 50 counts up and stores the total number of times the developer for supply is supplied (ΣX) (S4).

As described above, the hopper 31 block-supplies the developer for supply, so that the total number of times the developer for supply is supplied is equal to the total number of supplied blocks in this embodiment. A pitch of the supply screw 32 is set so that the supply amount per one block supply is 280 mg, so that the magnetic carrier is supplied into the developing device 4 in an amount of 28 mg per one block supply. Therefore, the control portion 50 can estimate an increment of the developer by counting the number of supplies blocks.

In this embodiment, as a shifting condition to the forced discharging mode, a table of the number of blocks necessary to shift to the forced discharging mode prepared by using the developer flowability change amount in Table 2 and the total number of times the developer for supply is supplied (ΣX) as parameters was newly defined.

That is, even in the case where the developer flowability is changed with the temperature rise, when the developer for supply is supplied and the developer amount in the developing container 22 is not increased, the developer overflow does not occur. Therefore, in this embodiment, the increment of the developer amount and the (developer) discharge characteristic were estimated from the number of supplies blocks (i.e., the supply amount) at a certain developer temperature and were fed back to the control.

The table of the number of blocks necessary to shift to the forced discharging mode employed in this embodiment was shown in Table 3.

TABLE 3

| Temp. | 20° C. | 30° C. | 40° C. | 50° C. |
|---|---|---|---|---|
| Yellow | 5000 | 600 | 450 | 200 |
| Magenta | 5000 | 800 | 550 | 250 |
| Cyan | 5000 | 800 | 550 | 350 |
| Black | 5000 | 1000 | 600 | 450 |

Here, a calculating method of this table will be described. First, the developers for each of the angles of repose were prepared. The developer supply amount necessary to increase the center developer amount of 330 g by about 20 g was estimated. Specifically, e.g., with respect to the yellow developer at 50° C., as also understood from FIG. 6, the developer cannot be discharged when the developer amount is 330 g. For this reason, when the developer is supplied in an amount corresponding to 200 blocks, the developer amount is simply increased by 20 g corresponding to the supplies carrier amount.

Therefore, when the forced discharging mode is executed at the time when the 200 block supply of the developer is made in a state in which the developer temperature is 50° C., it is possible to satisfy the developer amount of 350 g or less. In this way, with respect to each of the developers, the number of supply blocks for increasing the developer amount from the center developer amount 330 g by 20 g is calculated, so that the table (Table 3) is prepared.

As shown in Table 3, when the number of times the developer for supply is supplied reaches a predetermined number of the total number of times the developer for supply is supplied (ΣX) depending on the measurement temperature, the mode of the image forming apparatus is shifted to the forced discharging mode. Thus, an execution frequency of the forced discharging mode is defined by the number of times the supplying device is operated at an execution interval of the preceding forced discharging mode. In this way, after the preceding forced discharging operation is performed, when the sum of the amounts of the developer supplied into the developing container 22 reaches the predetermined amount, the forced discharging operation is performed. As a result, the developer amount in the developing container 22 can fall within a tolerable range from 330 g to 350 g in this embodiment.

The control portion (controller) 50 calculates the number (B) of blocks necessary to shift to the forced discharging mode by making reference to Table 3 at the current temperature (S5). Then, the control portion 50 compares the necessary block number (B) with the current total number of supply (ΣX) to judge whether or not the developer for supply is supplied in the amount corresponding to the number of the necessary blocks or more (S6).

In the case where the total number of supply (ΣX) is less than the necessary block number (B), i.e., B>ΣX (NO of S6), the image formation is continued. However, in the case where the total number of supply (ΣX) is not less than the necessary block number (B), i.e., ΣX≧B (YES of S6), the continuous image formation is interrupted and the forced discharging mode is executed (S7).

As shown in FIG. 11 with reference to FIG. 3, the control portion 50 stops the developing sleeve by stopping the driving motor M1 when the forced discharging mode is started (T1). Then, the control portion 50 increases the rotational speed of the driving motor M2 to 1.2 times the rotational speed of the driving motor M2 and changes the rotational speed of the feeding screws 25 and 26 from 750 rpm to 900 rpm (T2). Then, the feeding screws 25 and 26 are rotated for a predetermined time (1.5 sec), so that the excessive developer is forcedly discharged from the discharging portion 40 (T3).

Here, the rotation time of the feeding screws 25 and 26 may desirably be as short as possible in order to minimize downtime by the execution of the forced discharging mode and in this embodiment, the rotation time was uniformly set at 1.5 sec.

After the forced discharging mode is ended, the number of rotation (rotational speed) of the driving motor M2 is returned to an original value during the image formation (T4), and then the driving motor M1 is actuated to rotate the developing sleeve 28 (T5).

Finally, the total number of supply (ΣX) is reset to zero (T6), and the forced discharging mode is completed (S8) and then the operation is returned to the normal image formation (S9).

In the above discussion, the forced discharging mode executed in the yellow developing device 4*a* is described but the forced discharging mode is also independently controlled in the magenta, cyan and black developing devices 4*b*, 4*c* and 4*d*. In each of the developing devices 4*b*, 4*c* and 4*d*, the temperature/humidity sensor T is independently provided, and a table for control which is independent for each of the colors is provided in the control portion (controller) 50 and the forced discharging mode is executed with independent timing for each of the colors in an interruption manner.

However, in order to minimize the downtime of the image forming apparatus 100 accompanying the execution of the forced discharging mode, the forced discharging modes for the respective colors may desirably be executed simultaneously. For this reason, in the case where, e.g., the yellow developing device 4*a* satisfies the shifting condition to the forced discharging mode, the forced discharging modes may be executed simultaneously in the magenta, cyan and black developing devices 4*b*, 4*c* and 4*d* which do not satisfy the shifting condition to the forced discharging mode. At that time, the execution time of the forced discharging mode is made shorter with a smaller total number of supply (ΣX) integrated for each of the colors. As a result, it is possible to effectively obviate the excessive discharge for the development color for which the total number of supply (ΣX) is small.

Under the following conditions (1) to (4), the effect of the control in Embodiment 1 was confirmed by performing evaluation of the improper coating and the developer overflow with respect to the control in Embodiment 1 in which the forced discharging mode is executed and the conventional control in which the forced discharging mode is not executed.

(1) Under a high temperature/high humidity environment (30° C./80% RH) in which the probability of occurrence of the developer overflow is increased.

(2) A duty variation severe evaluation is performed on continuous $200\times10^3$ sheets.

(3) In the duty variation severe evaluation, output of a "chart with a full-color low print ratio (0%)" on continuous $20\times10^3$ sheets and output of a "chart of full-color high print ratio (100%)" on continuous $20\times10^3$ sheets are alternately performed.

(4) The developing device is demounted every output of the continuous $20\times10^3$ sheets and the entire weight of the developing device is measured. Then, the developer amount is measured by subtracting an initial weight of the developing device, in which the developer is not filled, from the entire weight of the developing device.

As a result, in the conventional control in which the forced discharging mode is not executed, the developer amount is largely fluctuated in the range from 300 g to 470 g in the duty variation severe evaluation. The developer amount reached 470 g when the cumulative number of sheets was $100\times10^3$, so that the developer overflow occurred and developer contamination of the output image occurred.

On the other hand, in the control in Embodiment 1, the developer amount was changed between 300 g and 380 g in the duty variation severe evaluation and no developer overflow occurred.

Further, the duty variation severe evaluation was performed under the environment condition in which the developer amount was increased, so that the improper coating caused by the insufficient circulate developer did not occur in both of the control in Embodiment 1 and the conventional control.

Incidentally, in Embodiment 1, in the case where the control portion judged that there was the need to execute the forced discharging mode, the forced discharging mode was executed by interrupting the image formation and by effecting forced interrupt control. However, the forced discharging mode may also be executed in a post-rotation sequence after the completion of the image formation. When this constitution is employed, the developer amount can be controlled without lowering the productivity of the image forming apparatus 100 as in the interruption control.

As described above, according to the control in Embodiment 1, even in the case where the temperature of the developer rises and the flowability is lowered, the necessary discharge amount of the developer to be discharged through the discharging portion 40, so that the developer overflow can be prevented.

Incidentally, as described in JP-A Hei 10-48937 and JP-A 2008-287079, when a particular discharging mechanism for the forced discharging is provided, the number of parts for the developing device is increased and a production cost is increased, so that it is difficult to downsize the developing device. Further, on the premise that the developing device is downsized, the discharge amount per unit time which can be imparted to the particular discharging mechanism becomes small. In the case of the discharging mechanism having the small discharge amount per unit time, when the discharging mechanism is actuated when the amount of the circulating developer approaches its upper limit, the developer amount exceeds the upper limit and thus the forced discharging cannot be performed in time.

Further, when the discharging mechanism is controlled after the upper limit and lower limit of the developer amount in the developing container are set, a fluctuation range of the amount of the circulating developer becomes large. This is because the developer flowability is lowered and the discharging performance of the developer through the developing device and thus the forced discharging mode is not executed until the developer amount actually reaches the upper limit. Further, when the fluctuation range becomes large, precise control of the toner charge amount becomes difficult, so that there is a possibility that the fluctuation in image density is caused to occur.

Further, when the amount of the circulating developer is increased, the preparation of the deteriorated toner having a long retention time is increased, so that the image density is fluctuated or the image defect such as the white background fog or the like is caused to occur. The rotation resistance of the feeding screw member is increased, so that power consumption is also increased.

In Embodiment 1, when the developer temperature is increased, the execution frequency of the forced discharging mode can be predictively increased before the developer amount is increased by suppression of the normal developer discharging through the discharging portion 40. As a result, the proportion of the developer lowered in flowability in the developing container is decreased, so that the normal developer discharging performance through the discharging portion 40 is restored. For this reason, the developer amount in the developing container is stably retained in a very small range, so that it is possible to move reliably avoid the occurrence of the developer overflow caused by the excessive developer.

Further, the discharging of the developer is performed by using the discharging portion 40 and the feeding screws 25 and 26 which have been already provided, so that there is no need to add parts for executing the forced discharging mode and therefore the forced discharging mode can be executed by a slight change in an existing control problem. By utilizing an existing part constitution of the developing device 4*a*, it is possible to enhance control accuracy of the developer amount in the developing container 22 without causing upsizing or the like of the developing device 4*a*.

In the developing device 4*a*, in the case where the temperature of the circulating developer exceeds a predetermined value, the flowability of the circulating developer is lowered and the discharging performance of the developer through the discharging portion, so that the amount of the developer circulating in the developing container is increased. However, in Embodiment 1, when the flowability of the developer is lowered, it is possible to predictively control the discharge amount of the developer without awaiting actual increase or decrease in developer amount. For this reason, compared with the case where the forced discharging control is effected by detecting the increase in developer amount, the developer amount can be retained stably in a narrower range. Further, by controlling the developer amount in the narrower range, the proportion of the developer lowered in flowability in the DC1 is lowered, so that an inconvenience attributable to the developer flowability lowering is alleviated such that the developer discharging performance through the portion is improved. By intermittently eliminating the excess of the developer, the inconvenience accompanying the change in flowability of the developer can be eliminated more directly. Further, the temperature is detected as the information correlating to the flowability of the circulating developer, so that there is no need to detect and control the amount itself of the developer circulating in the developing container.

Embodiment 2

A difference between this embodiment and Embodiment 1 is that the execution frequency of the forced discharging mode in this embodiment can be changed depending no the process speed. For example, in the image forming apparatus 100, in the case where thick paper is selected and the process speed is lowered, a low operation speed (reduced speed) is set for the feeding screws 25 and 26 shown in FIG. 3. At this time, the discharge amount of the developer through the discharging portion 40 is decreased and for this reason, the execution frequency of the forced discharging mode is increased in this embodiment.

In this embodiment, each of a first mode in which the image is formed at a first rotational speed of the image bearing member and a second mode in which the image is formed at a second rotational speed, of the image bearing member, slower then the first rotational speed is executable. The controller increases the frequency of the forced discharging operation in the second mode so as to be higher than that in the first mode and increases the execution time of the forced discharging operation in the second mode so as to be longer than that in the first mode.

The image forming apparatus 100 is operable in a ½-speed mode as a reduced speed mode (process speed=150 mm/sec) in which the image is formed on the thick paper or an OHP sheet, in addition to an normal mode (process speed=300 mm/sec) in which the image is formed on the plain paper or the like. In the ½-speed mode, the peripheral speeds of the photosensitive drum 1*a*, the intermediary transfer belt 5 and the fixing device 16 are reduced to ½ of those in the normal mode, so that sufficient transfer and fixation can be performed even with respect to the thick paper and the OHP sheet which are inferior in transferability and fixability to the plain paper.

In the normal mode, as described in Embodiment 1, the developing sleeve 28 is rotated at the peripheral speed which is 1.75 times the process speed, and the rotational speed of the feeding screws 25 and 26 is 750 rpm. On the other hand, in the reduced speed mode, the peripheral speed of the developing sleeve 28 is reduced at the same reduction ratio as in the case of the process speed and is ½ of that in the normal mode but the rotational speed of the feeding screws 25 and 26 is 600 rpm which is higher than ½ of 750 rpm. This is because when the feeding screw rotational speed is 375 rpm which is ½ of 750 rpm, the transfer of the developer from the stirring chamber 24 to the developing chamber 23 through the opening 11 shown in FIG. 3 is hindered. Further, this is also because when the feeding screw rotational speed is 750 rpm which is equal to that in the normal mode, the number of stirs per amount of toner consumption becomes excessive to accelerate the deterioration of the developer.

More specifically, if the developer feeding efficiency is not changed depending on the rotational speed, even when the rotational speed of the feeding screws 25 and 26 is reduced at the process speed reduction ratio, the height of the developer surface at the discharging portion 40 is not changed. However, in the developing device 4*a*, the transfer of the developer from the stirring chamber 24 to the developing chamber 23 is performed by a developer pushing force toward the opening 11 by the feeding screw 26. For this reason, when the rotational speed of the feeding screw 26 is reduced, the pushing force is lowered, so that the developer is less liable to be raised into the developing chamber 23 through the opening 11. For that reason, when the reduced speed mode is continued, the developer surface is gradually lowered in height at the discharging portion 40 and thus the excessive developer cannot be discharged, so that the developer amount in the developing container 22 becomes excessive and therefore the developer overflow is liable to occur.

For this reason, a circulation state of the developer, a quality of the output image and the developer overflow were evaluated by stepwisely increasing the rotational speed of the feeding screws 25 and 26 between 400 rpm and 1000 rpm by the use of the driving constitution of the driving motors M1 and M2.

TABLE 4

| | (in reduced speed mode) | | | | | | |
|---|---|---|---|---|---|---|---|
| Property | 400 | 500 | 600 | 700 | 800 | 900 | 1000 |
| C.B.*1 | C | B | A | A | A | A | A |
| Banding | A | A | A | B | C | C | C |
| D.O.*2 | C | C | C | A | A | A | A |

*1"C.B." represents a circulation balance.
*2"D.O." represents the developer overflow.
The evaluation standard is as follows.
A: No problem.
B: No problem but somewhat unstable.
C: Problematic.

As shown in Table 4, when the rotational speed of the feeding screws 25 and 26 is 600 rpm or more, it is possible to obtain the circulation balance which is equivalent to that in the normal mode. However, when the rotational speed of the feeding screws 25 and 26 is 700 rpm or more, the banding (pitch non-uniformity) occurred in the output image. For this reason, when a generating factor of the banding was studied in detail, it was found that the pitch non-uniformity was generated by vibration of a mirror on an optical path of a laser of the exposure device 3*a* due to vibration of the feeding screws 25 and 26 when the rotational speed was 700 rpm or more.

Here, when the number of rotation (rotational speed: 750 rpm) of the feeding screws 25 and 26 in the normal mode is reduced simply to ½, the amount of the vibration of the mirror is not changed from that in the normal mode. However, the process speed is reduced to ½, so that a laser writing pitch is increased to 2 times that in the normal mode and thus visual sensitivity to the pitch non-uniformity is increased.

However, as shown in Table 4, the developer discharging performance through the discharging portion 40 cannot be ensured sufficiently until the rotational speed of the feeding screws 25 and 26 is 700 rpm or more. At the feeding screw rotational speed of 600 rpm, the developer surface at the discharging portion 40 is lowered and thus the discharge characteristic cannot be satisfied, so that the developer overflow is liable to occur. When the execution frequency of the forced discharging mode in Embodiment 1 is set similarly as in the normal mode, the developer overflow cannot be prevented sufficiently.

In this embodiment, when the ½ speed mode is selected, the execution frequency of the forced discharging mode is made higher than that in the control in Embodiment 1. Specifically, the numerical values in Table 3 used in Embodiment 1 are made 0.8 times those in Table 3, so that the forced discharging mode is executed under each condition at the frequency which is increased by 20%. In the case where the image forming mode selected after the preceding forced discharging mode is the reduced speed mode, redundancy with respect to the developer overflow is lowered and therefore the forced discharging mode is executed at the time earlier than that in the normal mode.

TABLE 5

| | Necessary control number (B) | | | |
|---|---|---|---|---|
| Temp. | 20° C. | 30° C. | 40° C. | 50° C. |
| Yellow | 4000 | 400 | 80 | 24 |
| Magenta | 4000 | 367 | 78 | 23 |
| Cyan | 4000 | 374 | 76 | 22 |
| Black | 4000 | 384 | 73 | 21 |

As shown in Table 5, e.g., in the case where the image forming mode is the reduced speed mode and the temperature of the yellow developer is 50° C., 24 obtained by multiplying the necessary block number of 30 in the normal mode (Table 3) by 0.8 is taken as the necessary block number in the reduced speed mode.

In this embodiment, at the time of starting the image formation, whether the image forming mode is the normal mode or the reduced speed mode is judged. In the case where the image forming mode is judged as the reduced speed mode, the control is effected in a state in which the necessary block number is replaced with the necessary block number (B'). As shown in FIG. 10 with reference to FIG. 3, when the image forming operation is started, the temperature of the developer is measured (S1) and then the flowability change amount of the developer is estimated (S2). Then, the necessary block number (the number of supply or the supply amount) depending on the developer temperature is calculated as shown in Table 5 (S4). When the number of supply (S3) which is counted up every supply reaches the necessary block number (YES of S5), the forced discharging mode is executed in accordance with the control along the flowchart of FIG. 11 (S7).

Similarly as in the case of the normal mode executed under the conditions (1) to (4) described in Embodiment 1, an effect of the control in Embodiment 2 was confirmed by performing the duty variation severe evaluation in the reduced speed mode in which the forced discharging mode is executed and the conventional reduced speed mode in which the forced discharging mode is not executed.

As a result, in the conventional reduced speed mode in which the forced discharging mode was not executed, in the duty variation severe evaluation, the developer amount was largely fluctuated in the range from 290 g to 450 g. Further, the developer amount reached 450 g when the cumulative number of sheets reached $50\times10^3$, so that the developer overflow occurred and thus the output image was contaminated with the developer.

On the other hand, in the reduced speed mode in Embodiment 2, in the duty variation severe evaluation, the developer was changed between 290 g and 370 g, so that no developer overflow occurred.

In Embodiment 2, the results of the developer amount in which the developer overflow occurred and the change range of the developer amount in the duty variation severe evaluation are different from those in Embodiment 1. This may be attributable to a change in center value of the developer amount in the developing device 3*a* since slopes of the developer surface in the normal mode and the reduced speed mode are different from each other.

In Embodiment 2, even in the case where the reduced speed mode is set and the developer discharge characteristic is lowered, by executing the forced discharging mode, the amount of the developer circulating in the developing container 22 can be retained in a proper range and thus the developer overflow can be suppressed.

According to the control in Embodiment 2, in the image forming apparatus operable in the reduced speed mode in which the image forming operation is performed at a speed lower than that in the normal mode, the forced discharging mode is executed with a threshold which is different from that in the normal mode so that the developer discharge characteristic is not lowered in the reduced speed mode. As a result, it is possible to prevent the occurrence of the developer overflow caused by the lowering in developer discharge characteristic due to the difference in process speed.

Incidentally, in Embodiment 2, the case where the image forming apparatus is operated in the ½ speed mode as the reduced speed mode is described but the present invention can also be carried out in the image forming apparatus which is operable in a plurality of speed modes such as a ⅓-speed mode, a ¼-speed mode, a 1.5-speed mode, and the like. In that case, a correction coefficient may only be required to be set at a proper numerical value depending on each of process speeds associated ones of the speed modes.

Further, in Embodiment 2, the necessary block number (B) is subjected to the correction but is also possible to subject the number of rotation (rotation time) of the feeding screws 25 and 26 to the correction.

Embodiment 3

Figure 12:
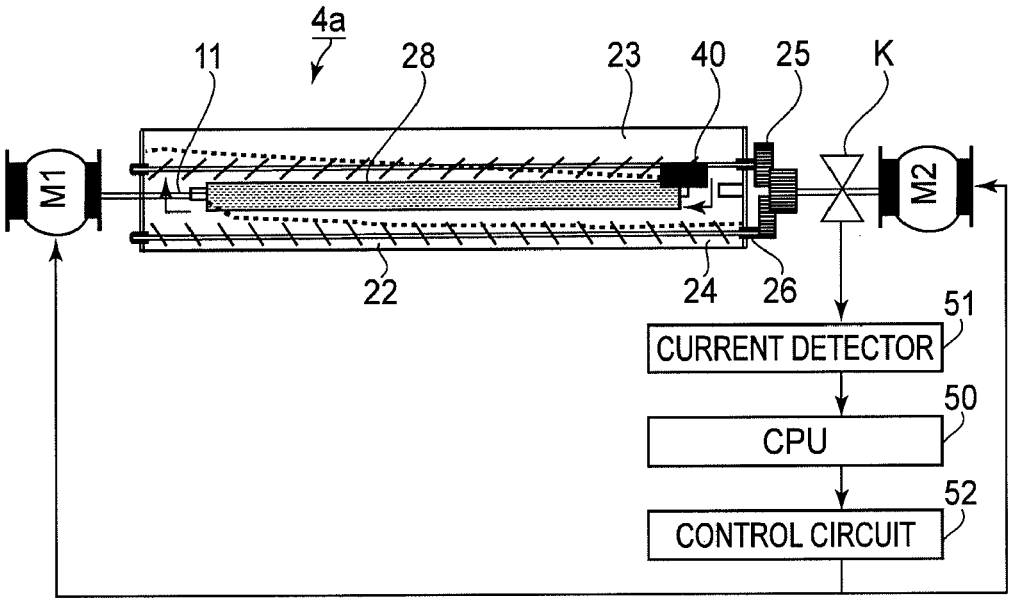
FIG. 12 is an illustration of detection of a driving load of a feeding screw in Embodiment 3.
Figure 13:
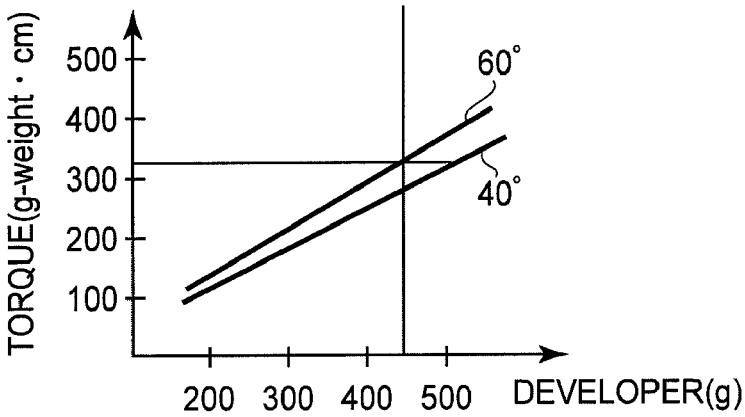
FIG. 13 is an illustration of a relationship between an output torque of a driving motor and flowability of the developer.
Figure 14:
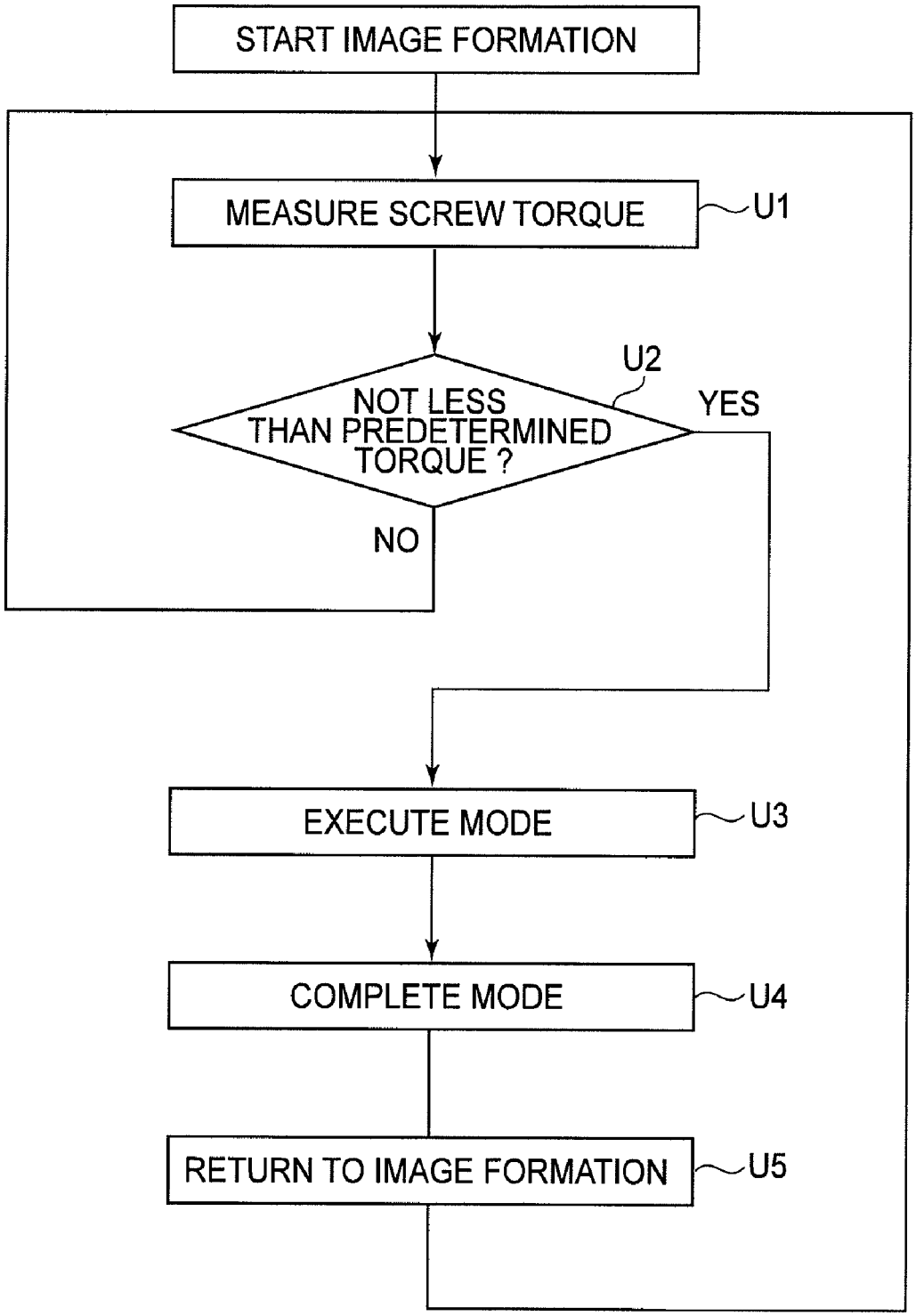
FIG. 14 is a flowchart of control in Embodiment 3.

A difference between this embodiment and Embodiment 1 is that the judgment of the execution of the forced discharging mode is not made based on the developer temperature but is made based on a driving torque of the driving motor. FIG. 12 is an illustration of detection of a driving load of the feeding screws in this embodiment. FIG. 13 is an illustration of a relationship between an output torque of the driving motor and the flowability of the developer. FIG. 14 is a flowchart of control in this embodiment. In this embodiment, the constitutions of the image forming apparatus 100 and the developing device 4*a* are similar to those in Embodiments 1 and 2.

As shown in FIG. 3, in this embodiment, in the case where the driving torque of the driving motor M2 exceeds a predetermined value and thus is increased, it is judged that the flowability of the developer is lowered and the discharge amount of the developer through the discharging portion 40 is decreased and for this reason, the execution frequency of the forced discharging mode is increased.

The flowability of the developer varies depending on a factor, other than the developer temperature, such that the developer flowability is gradually lowered with cumulative image formation, so that the amount of the developer circulating in the developing container cannot be estimated accurately when only the developer temperature is relied on in some cases. In this regard, the driving torque of the driving motor M2 is correlated with both of the developer amount in the developing container 22 and the developer flowability, so that proper execution timing of the forced discharging mode can be accurately judged without relying on the developer temperature.

As shown in FIG. 12, the driving load of the feeding screws 25 and 26 for stirring the developer occupies most of the output torque of the driving motor M2 and for this reason, the driving motor M2 is provided with a torque detecting sensor as a detecting means. The torque detecting sensor can detect an increase in "feeding resistance of developer by feeding screws 25 and 26" which is an example of the information correlating to the developer flowability.

With respect to the driving motor M2 which is a DC brushless motor, there is a proportional relationship between a current to be supplied and the output torque of the driving motor M2. In the driving motor M2, a current detecting resistance for detecting a load current is provided as a torque detecting sensor K. The control portion (controller) 50 obtains a potential difference, created between both ends of the current detecting resistance, through a current value detecting portion (A/D converter) 51 and calculates the driving torque of the feeding screws 25 and 26.

In the developing device 4*a*, when the developer flowability is lowered, i.e., when the angle of repose is increased, the slope of the developer surface is increased. When the slope of the developer surface is increased, the overflow of the developer through the discharging portion 40 is hindered and thus the developer amount in the developing container 22 is increased, so that the driving torque of the feeding screws 25 and 26 is increased. Then, when the increased developer is stagnated on the downstream side of the stirring chamber 24 and is in a locally compressed state, the driving torque of the feeding screws 25 and 26 are further increased.

For this reason, as shown in FIG. 13, the driving torque becomes larger with a larger angle of repose due to the lowering in flowability of the developer and with a larger developer amount in the developing container 22.

Therefore, by detecting the output torque of the driving motor M2, it is possible to estimate the developer amount and the slope of the developer surface. When the output torque of the driving motor M2 is increased, it can be judged that the developer amount is increased or the slope of the developer surface is increased. Thus, in either case, it is judged that the discharge amount of the developer through the discharging portion 40 is lowered and the possibility of the developer overflow is increased. For this reason, in this embodiment, the execution frequency of the forced discharging mode is changed depending on a detection result of the output torque.

As shown in FIG. 14 with reference to FIG. 12, the control portion (controller) 50 measures the driving torque exerted on the feeding screws 25 and 26 by the torque detecting sensor K when the image formation is started (V1).

Then, the control portion 50 judges whether or not the driving torque is not less than a predetermined level (specifically $3\times10^{-2}$ Nm (300 gF·cm)) on the basis of the detection result of the torque detecting sensor K (V2).

In the case where the driving torque is not less than the predetermined level (YES of U2), the control portion 50 judges that there is a need to execute the forced discharging mode and interrupts the image formation, and then executes the forced discharging mode in accordance with the control along the flowchart of FIG. 11 (V3). Then, the forced discharging mode is completed (V4) and the operation is returned to the normal image forming operation (V5).

In this embodiment, only on the basis of the detection result of the output torque of the driving motor M2 by using the torque detecting sensor K, start timing of the forced discharging mode is judged.

However, further stable control of the developer amount can be effected when the constitution in combination with the developer temperature detecting sensor T provided in Embodiment 1 or the constitution in combination with the reduced speed mode executed in Embodiment 2 is employed.

For example, during the normal operation, the control in Embodiment 1 or Embodiment 2 may also be effected while detecting the driving torque of the feeding screws 25 and 26. In this case, the threshold with respect to the execution of the forced discharging mode is decreased by multiplying the correction value by the necessary block number (B) shown in Table 3 or Table 5 depending on the detected torque amount, so that the execution frequency can be optimized. Further, a discharge time is increased by multiplying the rotation time of the feeding screws 25 and 26 by the correction value, so that it is also possible to adjust the discharge amount of the developer in the forced discharging mode.

According to the control in Embodiment 3, the developer amount or the slope of the developer surface can be always detected and controlled, so that it is possible to prevent the developer overflow or the improper coating even in the case where the developer amount is changed or even in the case where the slope of the developer surface is changed.

Embodiment 4

Figure 15:
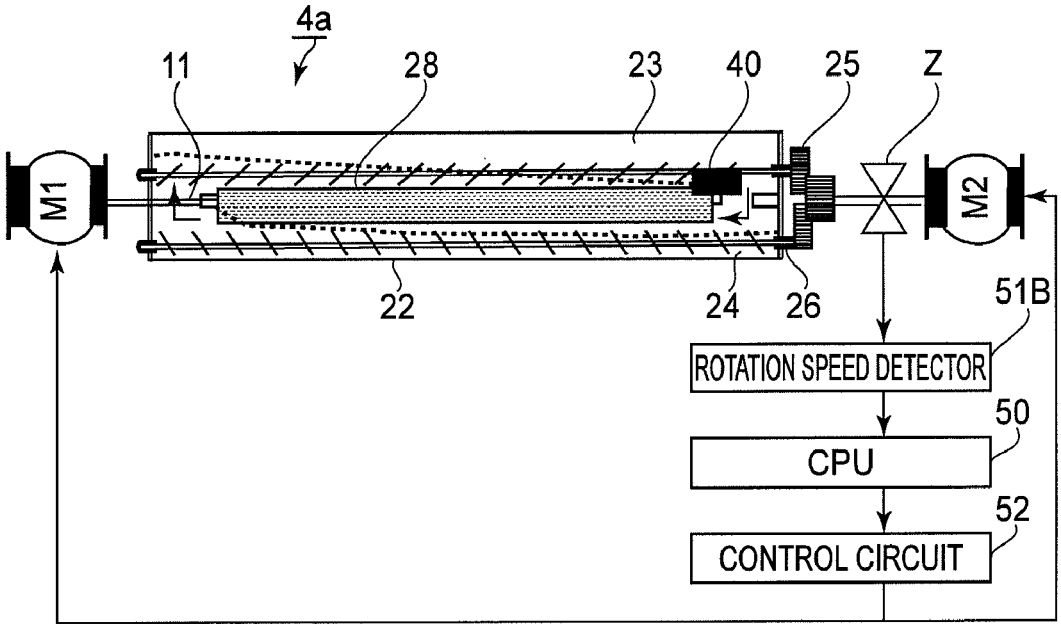
FIG. 15 is an illustration detection of a rotational speed of the feeding screw in Embodiment 4.
Figure 16:
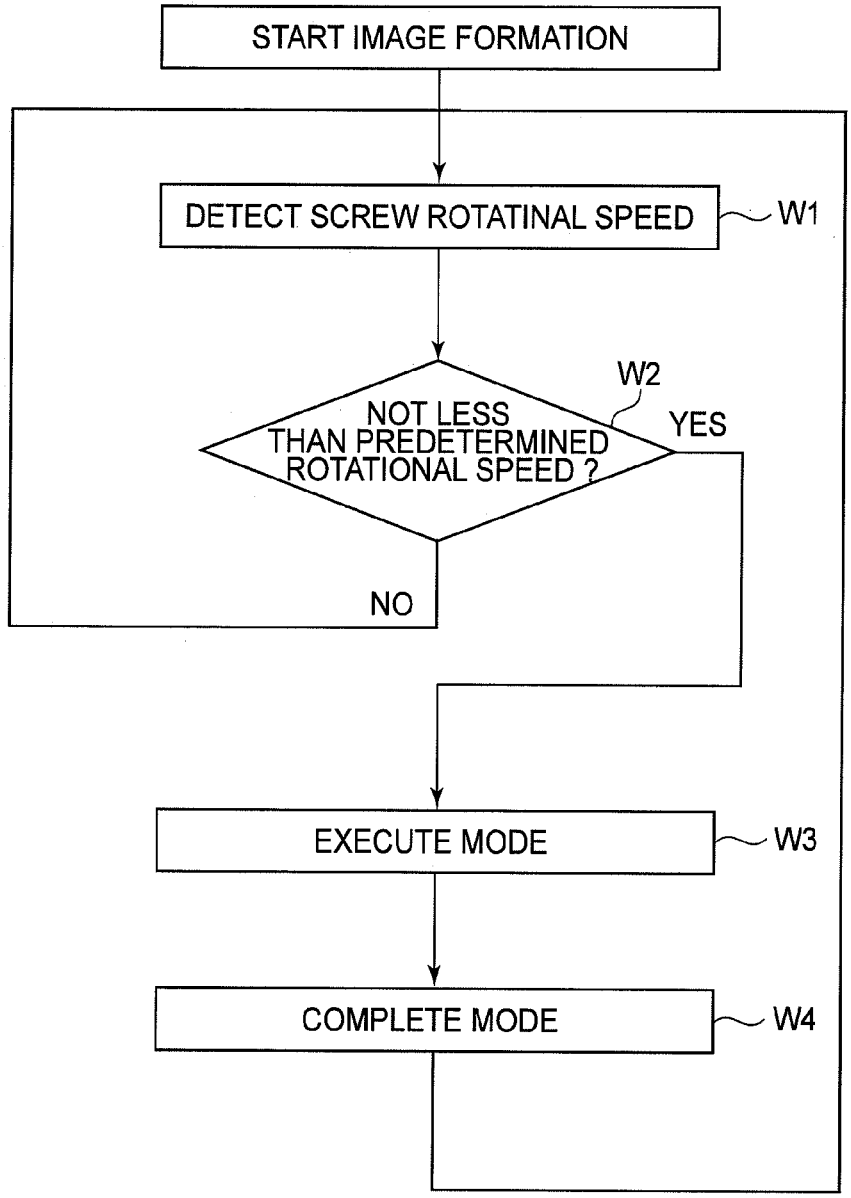
FIG. 16 is a flowchart of control in Embodiment 4.
Figure 17:
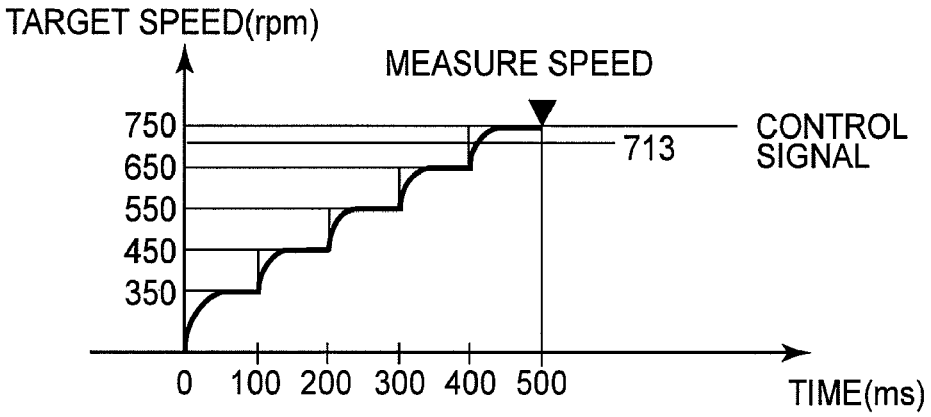
FIGS. 17(*a*) and 17(*b*) are illustrations of actuation control of a driving motor and a load check mode, respectively.
Figure 17:
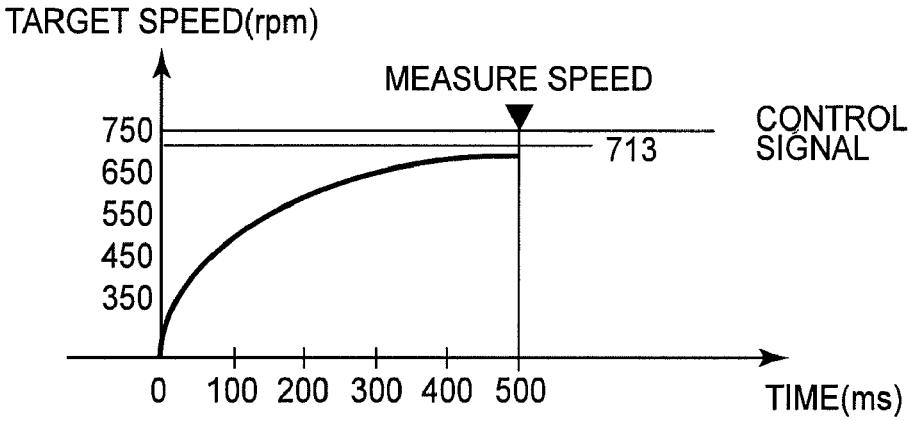

A difference between this embodiment and Embodiment 1 is that the judgment of the execution of the forced discharging mode is not made based on the developer temperature but is made based on the rotational speed of the driving motor. FIG. 15 is an illustration of detection of the rotational speed of the feeding screws in this embodiment. FIG. 16 is a flowchart of control in this embodiment. FIGS. 17(*a*) and 17(*b*) are illustrations of actuation control of the driving motor and a load check mode, respectively. In this embodiment, the constitutions of the image forming apparatus 100 and the developing device 4*a* are similar to those in Embodiments 1 and 2.

In the driving motor M2 which is the DC brushless motor, a time until the number of rotation converges to a certain number of rotation varies depending on a driving condition for acceleration and deceleration of the driving motor, a load to be driven at that time, and the like, so that the number of rotation cannot reach a predetermined number of rotation in some cases when a load is exerted in a certain amount or more. As a countermeasure thereto, a stepwise acceleration operation control in which the number of rotation is stepwisely changed in a predetermined step until the number of rotation reaches a final target number of rotation has been conventionally effected. Alternatively, control in which the number of rotation is always monitored and in the case where the number of rotation is judged not to reach the predetermined number of rotation (about 90% of the predetermined number of rotation as an actual specification), the motor is judged as improper rotation has been conventionally effected.

That is, the rising of the rotational speed when the driving motor M2 is changed depending on a driving load of the feeding screws 25 and 26 for stirring the developer. Further, a rising time for the number of rotation at the time of actuating the driving torque of the driving motor M2 is correlated with both of the developer amount in the developing container 22 and the developer flowability, so that proper execution timing of the forced discharging mode can be accurately judged without relying on the developer temperature.

In this embodiment, a rotational speed sensor Z as the detecting means for monitoring the rotational speed, of the feeding screws 25 and 26, which is an example of the information correlating to the developer flowability is provided. In the DC brush-less motor which is the driving motor M2 for the feeding screws 25 and 26, a magnetic sensor is provided, as the rotational speed sensor Z, on an outer circumferential surface of a rotor and enables the rotational speed detection. Further, the control portion 50 always monitors the rotational speed of the feeding screws 25 and 26 by the rotational speed sensor Z through a rotational speed (the number of rotation) detecting portion 51B. The control portion 50 judges that the developer flowability is lowered (or the developer amount is increased) when an abnormal lowering in rotational speed is detected, and increases the number of rotation of the driving motor M2 through a control circuit 52 to execute the forced discharging mode.

As shown in FIG. 16 with reference to FIG. 15, the control portion (controller) 50 detects the rotational speed, after a lapse of a predetermined time (500 msec in this embodiment) from the start of the rotation, of the feeding screws 25 and 26 by the rotational speed sensor K when the image formation is started (W1).

Here, the rising control of the driving motor M2 is effected by using the stepwise acceleration operation control in which the number of rotation is gradually increased every 100 msec as shown in FIG. 17(*a*), so that the number of rotation rises to the predetermined number of rotation (750 rpm) after 500 msec. In FIG. 17(*a*), a thin line represents a rotational speed control signal and a thick line represents a measured actual rotational speed.

Then, the control portion 50 judges whether or not the detected rotational speed is the predetermined rotational speed (750 rpm) (W2). In the case where the detected rotational speed is not more than 95% (713 rpm) of the predetermined rotational speed which is an example of the predetermined value (YES of W2), the control portion 50 judges that the load is excessive, and executes the forced discharging mode (W3). The control portion 50 interrupts the image formation and then executes the forced discharging mode in accordance with the control along the flowchart of FIG. 11. Then, the forced discharging mode is completed (W4) and the operation is returned to the normal image forming operation (W5).

Incidentally, in this embodiment, the rotational speed detection is performed at the time of the start of the image formation but, e.g., it is also possible to perform the rotational speed detection, during post-rotation after the completion of the image formation, in a load check mode. Further, in the case where the rotational speed detection is performed separately from the image formation, as the motor rising control, it is possible to effect control in which the rotational speed (the number of rotation) is accelerated to a final target rotational speed of 750 rpm in one stage shown in FIG. 17(*b*), not fine-stage acceleration operation control shown in FIG. 17(*a*). As a result, a delay of the rising of actuation due to the excessive load is liable to appear, so that it is possible to enhance detection accuracy.

In this embodiment, only on the basis of the detection result of the rising of the actuation of the driving motor M2 by using the rotational speed sensor Z, start timing of the forced discharging mode is judged.

However, further stable control of the developer amount can be effected when the constitution in combination with the developer temperature detecting sensor T provided in Embodiment 1 or the constitution in combination with the reduced speed mode executed in Embodiment 2 is employed. The forced discharging mode for discharging the excessive developer can be executed also in the case where the discharge characteristic of the developer is changed due to the change in flowability of the developer or due to the switching of the process speed.

For example, during the normal operation, the control in Embodiment 1 or Embodiment 2 may also be effected while detecting the rising of the actuation of the driving motor M2. In this case, the threshold with respect to the execution of the forced discharging mode is decreased by multiplying the correction value by the necessary block number (B) shown in Table 3 or Table 5 depending on a rising state of the actuation of the driving motor M2, so that the execution frequency can be optimized. Further, a discharge time is increased by multiplying the rotation time of the feeding screws 25 and 26 by the correction value, so that it is also possible to adjust the discharge amount of the developer in the forced discharging mode.

According to the control in Embodiment 4, the developer amount or the slope of the developer surface can be always detected and controlled during the actuation of the driving motor M2, so that it is possible to prevent the developer overflow or the improper coating even in the case where the developer amount is changed or even in the case where the slope of the developer surface is changed.

Embodiment 5

Figure 18:
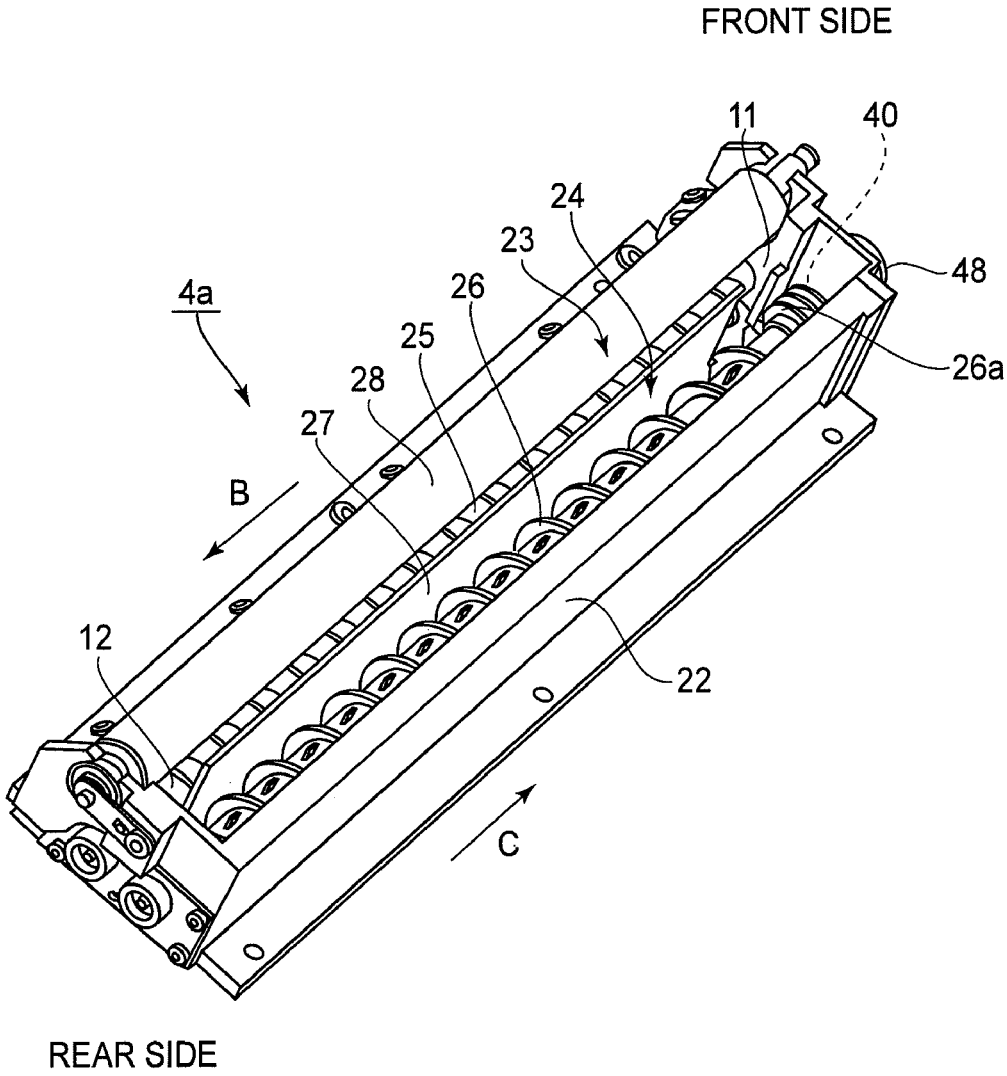
FIG. 18 is a perspective view of a developing device in Embodiment 5.

FIG. 18 is a perspective view a developing device in this embodiment.

In Embodiment 1 to Embodiment 4, the embodiments of the present invention applied to the vertical stirring type developing device is described but the present invention is also applicable to a horizontal stirring type developing device.

As shown in FIG. 18, the developing device 4*a* includes the developing container 22 which is divided into the developing chamber 23 and the stirring chamber 24 with respect to the horizontal direction by the partition wall 27. In the developing chamber 23, the feeding screw 25 is disposed and supplies the developer to the developing sleeve 28 while feeding the developer in a direction indicated by an arrow B. In the stirring chamber 24, the feeding screw 26 is disposed and feeds the developer in a direction indicated by an arrow C.

At both end portions of the partition wall 27 with respect to the longitudinal direction of the partition wall 27, the openings 11 and 12 are created and the developer is transferred between the developing chamber 23 and the stirring chamber 24 through the openings 11 and 12, so that the developer is circulated in the developing container 22.

At an abutment surface of the stirring chamber 24 with respect to the arrow C direction, the discharging portion 40 is created. At an end portion of the feeding screw 26 with respect to the arrow C direction, a reverse spiral portion 26*a* for pushing back the developer in the opposite direction is formed.

In the developing device 4*a*, the developer for supply containing the magnetic carrier is supplied in the neighborhood of the opening 12, so that the developer which is excessive by the supply of the developer for supply overflows from the discharging portion 40 and thus the amount of the circulating developer can be kept constant.

Also in the developing device 4*a* in Embodiment 5, a normal discharging performance through the discharging portion 50 cannot be achieved when the developer flowability is lowered and therefore the forced discharging mode is executed. The image formation is interrupted to stop the rotation of the developing sleeve 28 and the feeding screws 25 and 26 are rotated at a speed higher than that during the image formation, so that the developer rides over the reverse spiral portion 26*a* and is discharged through the discharging portion 40 in an amount larger than that during the normal operation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 196129/2009 filed Aug. 26, 2009, which is hereby incorporated by reference.

What is claimed is:

1. An image forming apparatus comprising:

an image bearing member for bearing a latent image;

a developing device, including a developer carrying member for carrying and feeding a developer including toner and a carrier to a developing position in which the developer opposes said image bearing member, for developing the latent image formed on said image bearing member;

a discharging portion for permitting discharge of an excessive developer present in said developing device by supplying the developer into said developing device;

a feeding member for feeding the developer in said developing device;

a controller for controlling a forced discharging operation for discharging the excessive developer from said discharging portion by changing a driving condition of at least one of said developer carrying member and said feeding member; and detecting means for detecting information correlating to flowability of the developer in said developing device, wherein said controller is capable of controlling the forced discharging operation so that a frequency or execution time of the result forced discharging operation when the flowability the developer in said developing device is lower than a predetermined value is higher or longer than that of the forced discharging operation when the flowability of the developer in said developing device is higher than the predetermined value.

2. An apparatus according to claim 1, wherein said controller is capable of performing the forced discharging operation when a sum of amounts of the developer supplied into said developing device after a preceding forced discharging operation is completed reaches a predetermined value, and wherein the predetermined value is changed on the basis of the detection result of said detecting means.

3. An apparatus according to claim 1, wherein the information correlating to the flowability of the developer is a temperature in a main assembly of said image forming apparatus, a driving torque of said feeding member, or a rotational speed of said feeding member.

4. An apparatus according to claim 1, wherein said developing device further includes a first chamber for accommodating the developer and a second chamber, provided adjacent to the first chamber with respect to a gravitational direction, for forming a circulating path together with the first chamber, wherein the developer in the first chamber and the second chamber is circulated by said feeding member, and wherein at least one of the first chamber and the second chamber is provided with a discharge opening.

5. An apparatus according to claim 1, wherein said image forming apparatus is capable of executing a first mode in which image formation is effected at a first rotational speed of said image bearing member and a second mode in which the image formation is effected at a second rotational speed, which is lower than the first rotational speed, of said image bearing member, and wherein said controller is capable of controlling the forced discharging operation so that a frequency or execution time of the forced discharging operation in the first mode is larger or longer than that of the forced discharging operation in the second mode.

* * * * *